US008443577B2

(12) United States Patent
McWilliams

(10) Patent No.: US 8,443,577 B2
(45) Date of Patent: May 21, 2013

(54) METHOD AND DEVICE FOR SAFE HANDLING AND REMOVAL OF BODILY REMAINS

(75) Inventor: Edward L. McWilliams, San Diego, CA (US)

(73) Assignee: Barrier Products, LLC, San Diego, CA (US)

( * ) Notice: Subject to any disclaimer, the term of this patent is extended or adjusted under 35 U.S.C. 154(b) by 1583 days.

(21) Appl. No.: 11/473,798

(22) Filed: Jun. 23, 2006

(65) Prior Publication Data

US 2010/0048974 A1 Feb. 25, 2010

Related U.S. Application Data

(60) Provisional application No. 60/693,322, filed on Jun. 23, 2005.

(51) Int. Cl.
*B65B 41/18* (2006.01)

(52) U.S. Cl.
USPC ..... 53/173; 53/176; 27/28

(58) Field of Classification Search
USPC ..... 53/173, 176, 170, 172, 556; 27/28, 27/35, 7
See application file for complete search history.

(56) References Cited

U.S. PATENT DOCUMENTS

| | | | | | |
|---|---|---|---|---|---|
| 333,142 | A * | 12/1885 | Clapp | 27/2 |
| 924,029 | A * | 6/1909 | Barnes | 27/2 |
| 2,279,694 | A * | 4/1942 | Martinson | 5/627 |
| 4,780,940 | A * | 11/1988 | Jay | 27/28 |
| 5,483,785 | A * | 1/1996 | DiCarlo | 53/556 |
| 5,659,933 | A * | 8/1997 | McWilliams | 27/28 |
| 6,052,877 | A * | 4/2000 | Richard | 27/1 |
| 6,405,510 | B1 * | 6/2002 | Viaud | 53/118 |
| 6,758,028 | B1 * | 7/2004 | Underhill | 53/587 |
| 7,373,704 | B1 * | 5/2008 | Blacklock | 27/28 |

* cited by examiner

*Primary Examiner* — Sameh H. Tawfik
(74) *Attorney, Agent, or Firm* — Husch Blackwell LLP

(57) ABSTRACT

A portable device that can be taken to the site of biological remains is provided. The device includes means for holding and dispensing one or more types of sealable shielding elements within which to seal remains. The device also includes means to temporarily hold the remains while the sealable shielding elements are placed about the remains and sealed. The device includes means to hold one or more rolls of one or more types of sealable shielding materials to first protect the user and the shielding elements from sharps and then seal, including heat sealing, the body and/or toxic or caustic elements from the population before disposal.

14 Claims, 21 Drawing Sheets

METHOD AND DEVICE FOR SAFE HANDLING AND REMOVAL OF BODILY REMAINS

FIELD OF THE INVENTION

The present invention concerns a method and device to assist in the removal of bodily remains and/or hazardous materials. More particularly the present invention concerns a portable device that can be taken to the location of remains that might prove a health hazard, for safe sealing, including heat sealing, and removal of the remains; and a method of using the device.

BACKGROUND OF THE INVENTION

With more advanced knowledge of the dangers of toxic elements and the increases likelihood of attacks on civilian populations, including attacks with chemical, biological and/or nuclear agents, the safe and rapid removal of remains has become a salient issue. Further, large natural disasters, such as tsunamis, earthquakes, hurricanes, floods and other acts of nature, can cause mass fatality situations; such situations typically being accompanied by lack of electricity and other municipal services. Communities are aware of the hazards of any human or animal remains and the toxicity and other dangers of ordinary remains left unattended. In addition, remains left as a result of death caused by the agents listed above, either accidentally or intentionally, or by acts of terror or war, are particularly hazardous to the remaining population. It is therefore paramount to provide devices and methods for the removal of such remains that are safe and easy for workers to use and that prevent the further spread of caustic, noxious, toxic or otherwise deadly elements and/or biological contamination to the remaining population.

Presently, bodies, or toxic materials, found in such "hot zones" are gathered, in the best scenarios, by persons wearing hazardous material (so called "haz-mat") suits; the remains being placed in conventional body bags or other ordinary storage materials. While the workers in such arenas are somewhat protected, the transportation of hazardous remains and other materials without adequate protection to the surrounding population, can cause further and more serious health hazards. Further, in situations where large scale deaths or spread of toxic materials have occurred, the quick isolation of the materials in sealed environments cannot usually be done easily, and the continued exposure of the atmosphere and environs to such materials compounds the problems caused even further.

SUMMARY OF THE INVENTION

In accordance with the present invention a device and method for removal of remains or hazardous items, including removal of such materials from within a hazardous zone or "hot zone" is provided. In accordance with the present invention, a portable device that can be easily assembled away from the site of a "hot zone" and then quickly taken to the site of biological remains, toxic chemicals or other hazardous items is provided. The device includes means for holding and dispensing one or more types of sealable shielding elements within which to double seal remains or other hazardous or supposed hazardous materials. Further, the device includes means to temporarily hold the remains while the sealable shielding elements are placed about the remains and sealed. The contained remains or materials are thereby rendered generally harmless for removal and/or storage.

Shielding elements, including plastic and/or metal impregnated sheathing materials, and other materials, such as those shown in U.S. Pat. No. 5,659,933, are of the type which can be used in association with the device of the present invention to practice the method thereof. The '933 patent is owned by the owner of the present invention; its disclosure is incorporated herein by reference as if set out herein in full.

In one embodiment of the present invention, the device is placed on a cart or trailer and can be attached behind a vehicle so that it can be transported to sites as needed. In such an embodiment, power for elements of the device can be provided by the vehicle or through alternatives, such as portable generators carried on the vehicle or on the device. Power may be required for sealing and vacuum elements of the device, as well as any type of communication or electronic identification elements that can be incorporated in the device, the sealing elements or in association with the method of the device.

In one or more embodiments, the device includes means to hold one or more rolls of one or more types of sealable shielding materials. In one or more embodiments of the present invention, a first shielding material is used to first hold remains and provide a first barrier against sharp elements which may be carried by or be elements of the remains. A second shielding layer, having sealable properties and properties that tend to make a barrier against the escape of toxic or otherwise hazardous materials, is provided to cover the first shielded remains. The device of the present invention includes means, including heat sealing and adhesives, to seal one or more layers of shielding materials such that the contents, including bodily remains, and/or toxic or caustic elements or materials, are sealed within the shielding materials.

In a further embodiment, means to remove all or most of the gaseous environment from within the bag, such as by vacuum or suction means, is employed in order to remove toxic or hazardous gases, and to provide a more compact package for easier transportation and storage, are provided.

A method of use of the device of the present invention is also described herein. In one preferred embodiment, the device is assembled and can be activated in a safe location and then transported to the vicinity of one or more hazardous sites. The device is designed for easy and quick portability such that it can be moved to areas where multiple bodies or other remains or materials occur and then, upon completion of the work in that area, be quickly and easily moved again. In this manner, users of the device are not taxed by carrying items long distance. It will be understood that the use of the device of the present invention in the practice of the method of the present invention will likely be done by persons dressed in hazardous material (so called "haz mat") suits. Further, such use may occur in periods of warm or hot weather making for near intolerably conditions for those so equipped.

Upon reaching the area of a catastrophic or hazardous event, the device is then easily set into working order, by placing the assembled device in an advantageous location and then merely leveling the device. In one preferred embodiment two teams of workers are provided per device; one team to secure materials or bodies to be sealed up and deliver the same to the device and another team to do the actual sealing.

In the present embodiment, as will be explained in greater detail below, in association with the drawing figures included herewith, the securing team will be provided with a carrying board. The team will approach the body or materials and carefully, so as not to put pressure on the item(s) to be contained (which may cause the expulsion of gas or other substances from the items to be contained) place the materials or body on a carrying board. The board can then carried to the device and placed on a first upper platform. The material and/or body can then be manipulated in a manner to be described in greater detail below, so as to permit the material and/or body to be first encased in a three sided envelope of first encasing material and then further concentrically encased in a second three sided envelope of second encasing material; such that the body or material and the upper platform are within the two containment envelopes. The enveloped material and/or body are then manipulated, off of the first or upper platform and onto a lower, more easily accessible platform of the device. In one embodiment, the upper platform is part of a trolley system, whereby it can easily be pushed out of the way while the enveloped body drops gently to a second lower platform. Whereupon the first encasing material is sealed, the sealed end being rolled and placed within the second envelope. The open end of the second envelope is then sealed, enclosing the material or body within a double sealed package. The enveloped and sealed body is then removed from the device and the upper platform is returned to its first enveloping position.

In a preferred embodiment, each envelope is double sealed to provide a secure sealed bag. In a preferred embodiment sealing is done by a heating element that fuses the sides of the containment envelope together. A first heat seal is done to the envelope and then the material is moved such that a second heat seal may be applied. In this manner heat sealing of human remains, and other undesirable elements, is quickly and efficiently accomplished.

In one embodiment, prior to the sealing of each envelope, a suction or vacuum device (having significant filtering mechanisms of a type well know by persons having ordinary skill in the art) is first used to remove air from each envelope prior to sealing, so as to affect a vacuum seal. A vacuum seal will have the beneficial effect of removing toxic gases which otherwise could escape at a future time (such as when an autopsy is performed) and compacts the package such that easier transportation and storage are effected.

In a further embodiment, an identification element is placed on or in the sealing envelope. Such identification devices, such as an RFID device, bar code label, simple identification label, DNA storage capsule, or other device or devices well known to persons having skill in the art, will assist in identifying the remains at a later time, without having to open the sealed envelopes exposing workers to the hazardous elements therewithin.

A more detailed explanation of the invention is provided in the following description and claims and is illustrated in the accompanying drawings.

DETAILED DESCRIPTION OF THE ILLUSTRATIVE EMBODIMENT

Figure 1:
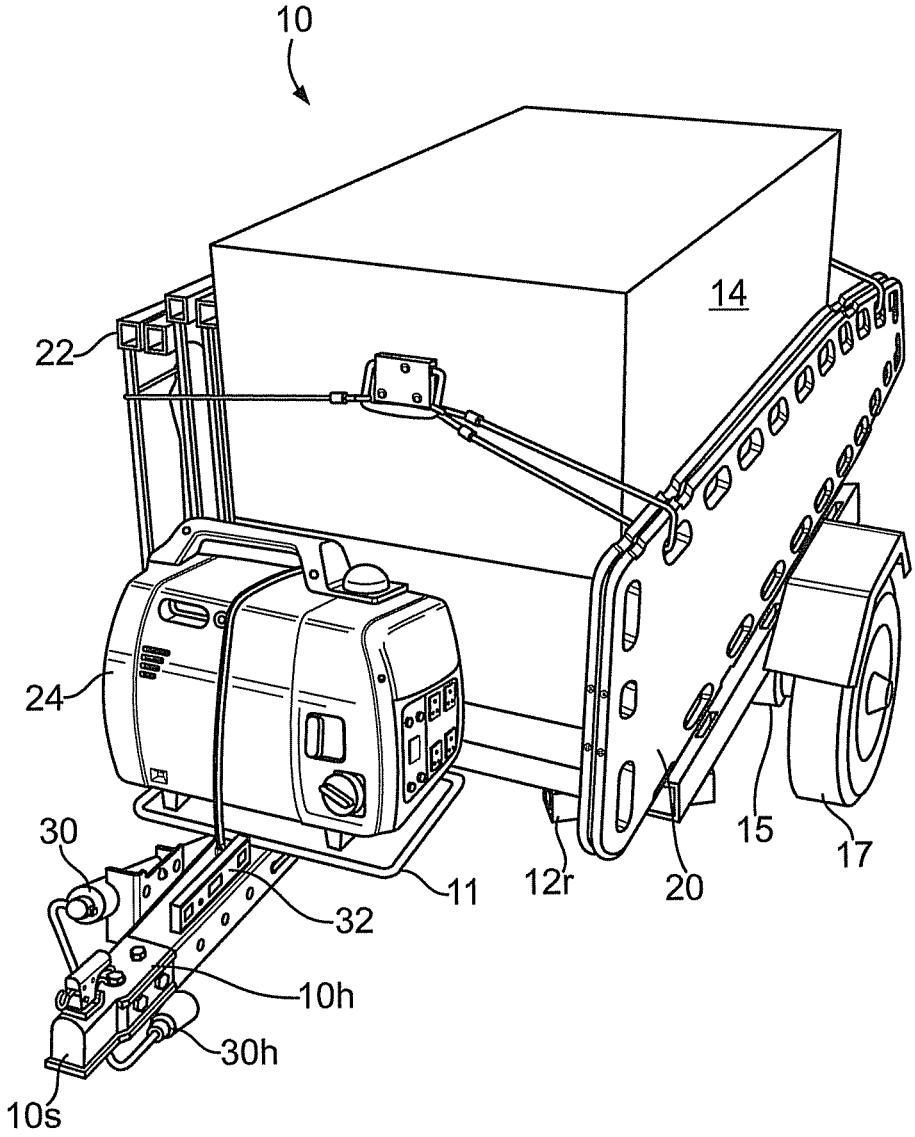
FIG. 1 is a perspective view of a device made in accordance with the teachings of the present invention in a first transportable configuration.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of an Illustrative Embodiment") relates to a requirement of the United States Patent Office, and should not be found to limit the subject matter disclosed herein.

As shown in the figures, a preferred embodiment of the device 10 of the present invention is shown. It will be understood that various modifications can be made to the device shown, including variations materials, power sources, sizes of elements and manners of uses of the device, without departing from the novel scope of the present invention. The device of the present invention has been constructed using items easily found in hardware and building centers such that the cost and ease of construction have been made economical and easy.

Figure 2:
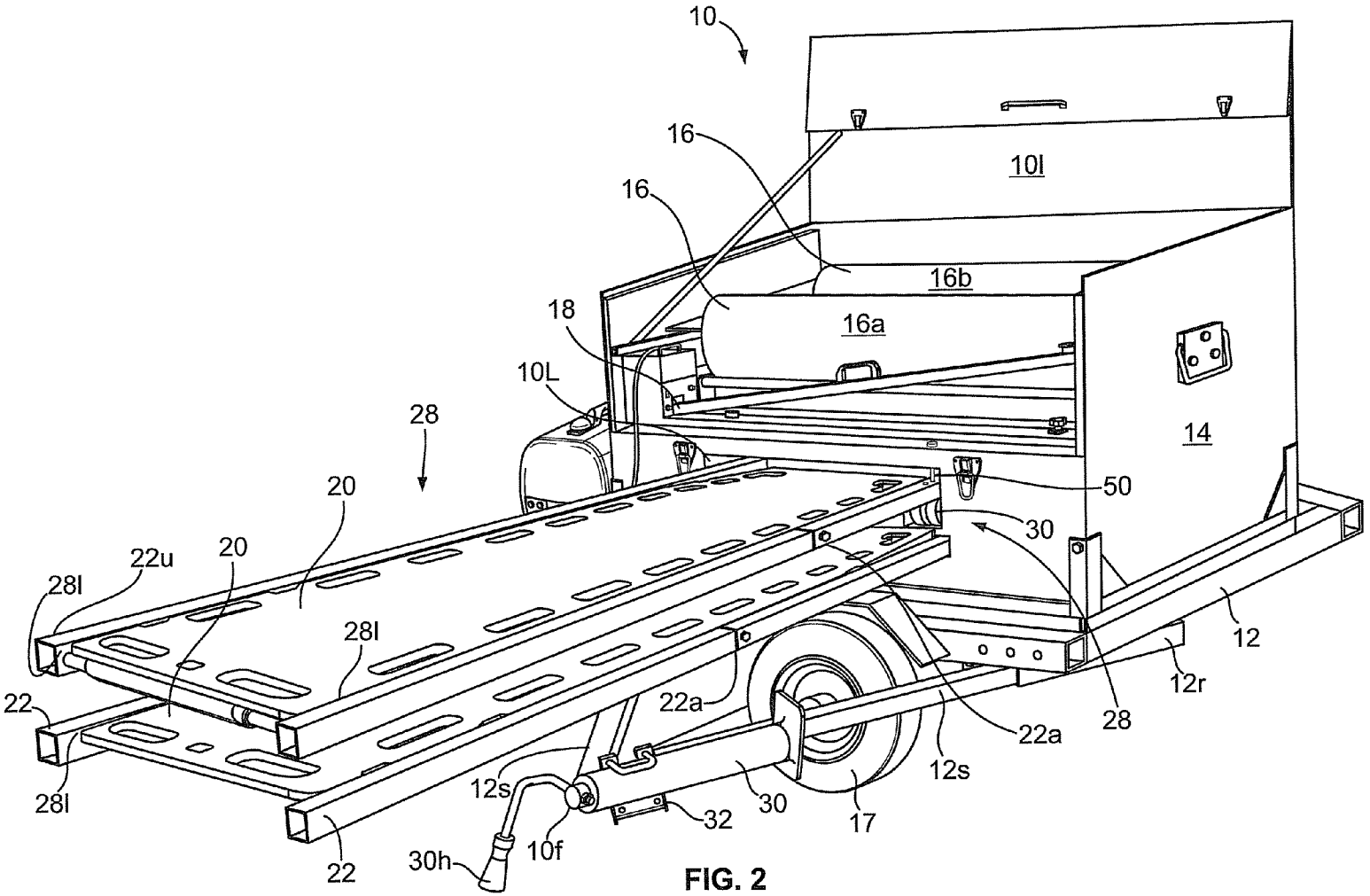
FIG. 2 is a further perspective view of a device of the present invention in a second prepared for use configuration.

The device 10 includes a cart 12 for mobility of the device, a container or case 14 as well as means to hold rolls 16 of shielding materials, shown in FIG. 2. The device 10 includes means to hold remains 13 while first and second shielding materials, respectfully 16*a* and 16*b*, are first placed about the remains 13 and then sealed. The device includes means to provide one or more seals so that shielding is made complete and difficult to defeat; in a preferred embodiment the sealing means includes a heat sealing device 18. It will be understood that other methods of sealing, including the use of adhesives and clips of various types, may be employed without departing from the novel scope of the present invention.

In a preferred embodiment, an emergency services department of a city, or other municipal unit, is prepared for an emergency response to mass fatality incidents, having hundreds and possibly thousands dead bodies, by having one or more of the devices of the present invention. It will be understood by persons having ordinary skill in the art that the present invention can be used with any number of fatalities as well as with any manner of dead animal, waste product (whether biological, chemical or other), or other undesirable objects or elements, without departing from the novel scope of the present invention.

The device 10, as shown in the various figures, can be easily assembled. In a preferred embodiment, and using a preferred assembly method, a device of the present invention can be assembled by two men in about three and a half minutes. It will be understood that the device shown is one embodiment and that other embodiments, including embodiments needing no assembly or some needing more assembly, can be substituted without departing from the novel scope of the present invention. Further, it will be understood that the time of assembly of such a device will be dependent on the familiarity of the device by the assemblers and the conditions for assembly at the situs of use.

Referring to FIGS. 1 and 2, device 10 includes boards 20, of a type typically found on ambulances and/or other emergency vehicles and is often referred to as spine boards. Such boards 20 are ideal for retrieval of remains and are typically made of lightweight and strong materials. It will be understood that any manner of rigid board, strong cloth webbing, or other means to tote bodies in the field, can be utilized to secure and transport bodies or materials without departing from the novel scope of the present invention.

The device 10 of the present embodiment is designed to be used to handle and manipulate bodies and materials 13, as will be discussed below.

It will be understood that the device 10, in a preferred embodiment of the present invention is powered by electricity. It will be further understood that the device 10 can be attached to various sources of electricity including a power inverter (not shown), so that it can be electrically powered via a battery operated automotive vehicle 23. In the event of an emergency situation, and in typical events where deaths or the discovery of undesirable elements are found in remote areas, electricity is generally unavailable except through batteries or generators. It will be understood that preferred embodiments of the device 10 of the present invention can be constructed to run on typical alternating current power, battery power, generators or other electrical means without departing from the novel scope of the present invention. Further, step down means and other devices that permit the device to be used with both domestic and foreign power sources can be utilized such that the device of the present invention can be use anywhere in the world. A preferred embodiment of device 10 of the present invention includes a platform 11 onto which a power generator 24 can be carried for convenience, and as will be described in detail below.

Figure 4:
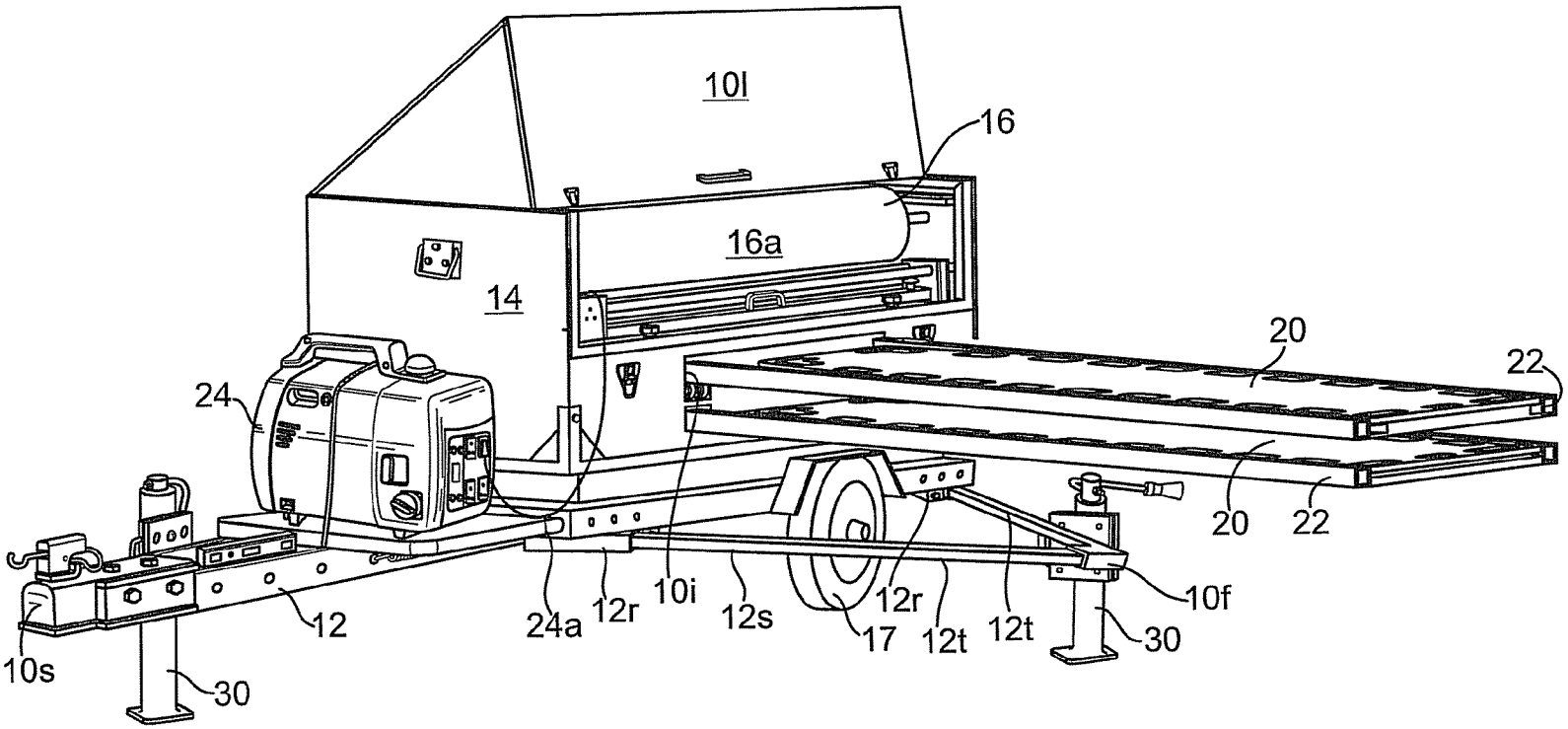
FIG. 4 is another perspective view, taken from the front and side, showing the device in a prepared for use configuration.

In a preferred embodiment of the present invention, device 10 is provided with a trailer 12, having one or more axles 15, having tires 17, for ease of transportation and to set the device 10 at a convenient height for use and transportation. Trailer 12 includes a hitch means 12*h* and is provided with support spans 12*s* (FIG. 2). Support spans 12*s* can, in a preferred embodiment, be detachable structural elements which can be transported and stored on trailer 12, and assembled onto trailer 12 when needed. In one embodiment, support sleeves 12*r* are included on the underside of trailer 12 and support spans 12*s* are inserted therein and attached together, in a manner known by persons having ordinary skill in the art, so as to form a structural triangle 12*t* (FIG. 4) with the trailer 12.

In the illustrative embodiment, as shown in FIGS. 10 through 13, users 26 of the device 10 assemble a trolley 28; the device 10 includes racks 22 which are used to create trolley 28. Racks 22, in a preferred embodiment, are structural track-like members capable of sustaining weights greater than that of a human being. Racks 22, in a preferred embodiment (see FIG. 3) include parallel structural tube elements 22*t* joined by a series of support bars 22*b* in a ladder-like formation. Bars 22*b* separate tubes 22*t* such that board 20 can lay snuggly within tubes 22*t* so as to provide adequate support for a body 13 (or other materials) while maintaining the board 20 from sliding laterally off of rack 22, as illustrated. In a preferred embodiment, racks 22 are each provided in two easily assemblable sections and stored, when not in use, on the cart 12 of device 10 (as shown in FIG. 1). It will be understood by persons having ordinary skill in the art that any manner of structural element that can provide support for a board 20, or other similar body carrying device, and can be integrated in a device of the type illustrated, can be used without departing from the novel scope of the present invention. Racks 20 can be made of any structural material, including steel, wood, titanium, graphite, fiberglass, and/or any other tough, strong, resilient materials or combinations of materials.

Figure 3:
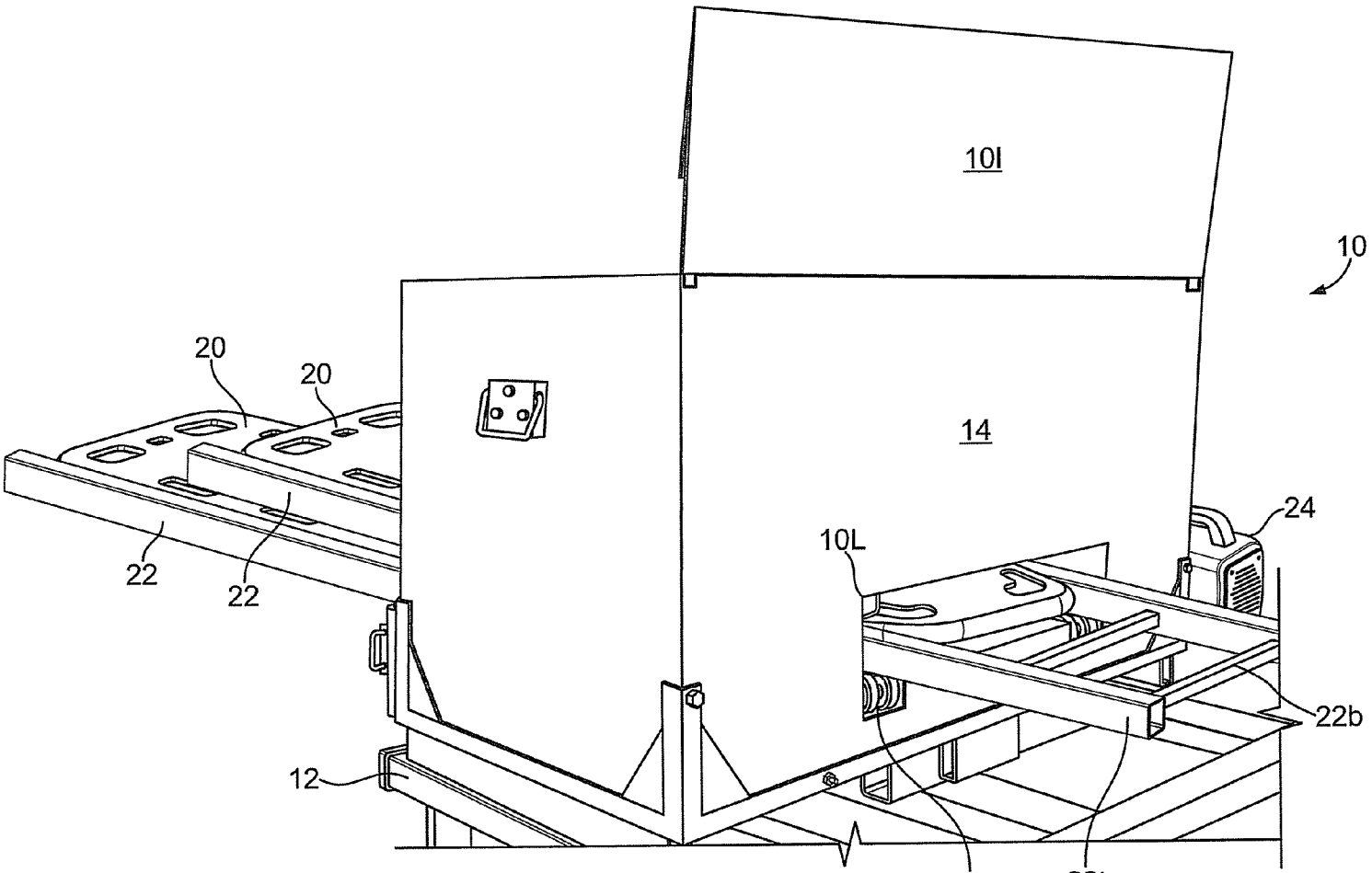
FIG. 3 is partial rear perspective view of a device of the present invention showing one element of the device in an intermediate use configuration.

In assembly of device 10, rack portions are assembled together into racks 22, by easy friction fit (as will be known by persons having ordinary skill in the art) and then joined by a pin 22*a* to provide joiner and connective strength. As can be seen in FIGS. 2 and 3, upper rack 22*u* rides on wheels 30 to effect a trolley device 28 that allows rack 22*u* to be inserted into and pushed through opening 10*i* in device 10, in a manner to be described in greater detail below.

As shown in FIG. 1 and FIGS. 10 through 13, power, in the illustrative embodiment, is provided by a small generator 24, housed on platform 11, which the users 26 will connect to the device of the present invention using a power cord 24*a*. As explained above, any convenient power source can be used to power the device of the present invention, without departing from the novel scope of the present invention.

Referring now to FIG. 2, the device 10 is shown in a ready-to-respond configuration; the users 26 being prepared to transport themselves with the assembled device 10 into a so called "hot zone", in order to respond to, for example, a mass fatality incident.

Once the response team (comprised of one or more attendants 26) is in position with the assembled device 10, they will pivot a leveling device 30, which is illustrated as hydraulic jack 30 having a handle 30*h* for raising and lowering the jack, attached to the front 10*f* of the device 10. The device 10, in one embodiment, includes an adjustable hitch 23*h* (at side 10*s* of the device 10) that is attached to vehicle 23. Once in place the level of the device is checked and adjustments are made using adjustable hitch 23*h*, or hydraulic jack 30 (as illustrated in a folded away position), which can be adjusted using a lever, or as illustrated, a socket wrench 23*w*. In order to check that the device is level, a simple magnetic level 32, of a type well known in the art, is applied and first leg 30 of the device is adjusted so as to level the front 10*f* of the device 10. The response team can then put the level 32 at the side 10*s* of the device 10 (FIG. 2) and the hitch device 23*h* (first used in towing the device to the location) can then be manipulated to raise or lower the device 10 as needed. Other types of means to level the device, including other types of jacks, trailer hitches, blocks and others can be substituted for the means illustrated without departing from the novel scope of the present invention. Such leveling devices can have levers, socket wrenches 23*w* (FIGS. 10, 12 and 13) or other means that permit the user to manipulate the leveling means 23*h*, 30 to provide the necessary fine adjustments in leveling, as will be understood by persons having skill in the art. Further, as shown in the figures, a hydraulic lift leveling device 30 can also be included, both at the side of the device 10*s* and at the front 10*f*, so that leveling can be done even if the vehicle 23 is caused to leave the device 10 taking hitch means 23*h* with it. It will also be understood, by persons having ordinary skill in the art, that the device 10 can include self leveling devices and other means to provide a level platform for work, without departing from the novel scope of the present invention. In one embodiment of the device of the present invention, the trolley can be used without leveling in situations where time taken to level can prove dangerous to the users 26 of the device. All such permutations of the leveling and non-level uses of the device 10 are contemplated and fall within the novel scope of the present invention.

For clarity and simplicity, it will be understood that the device 10 and method of the present invention can be used in association with bodies, body parts, toxic and hazardous materials and other items and things (all designated item 13 in the figures); and that reference to one or more of these items or things herein will include the use of the device 10 on any one or more of these things 13. Further it will be understood that the use of the plural shall include the use of the singular and the use of the singular will include the use of the plural.

Once in position, the response team will approach a body 13, or other undesirable element, typically wearing "haz mat" 26*h* suits and carrying a spine board 20 or other rigid platform for carrying a body 13. In the practice of the method associated with the device, one attendant 26 will roll the body 13, no more than 90 degrees, such that the board 20 can be placed partially under the body 13, while another attendant 26 slips the board 20 part way underneath the body. The attendants 26 will both then roll and slide, and otherwise manipulate the body 13 onto the board 20. As will be understood by persons having ordinary skill in the art, it is never, under any circumstances, desirable to compress the abdominal cavity of a body or to compress toxic or hazardous waste. It will be understood that if the body 13 expired due to an inhalation of a biochemical weapon or other toxic materials, compressing the abdominal cavity can cause the ejection of any such product into the vicinity of those working thereabouts, such as other users of the present device and method. It is for this reason that bodies 13 are rolled to their side, the board is placed underneath, and the body is rolled and slid onto the board 20 and then the lifted. Elevation can generally be done from the side of the board 20 so that the body 13 does not slide off of the board during transport to the device 10. The body is elevated by the members of the recovery team and then walked to the device for sealing. It will be understood that one of the purposes of making the device portable, that is putting it on wheels and allowing it to be moved from location to location while generally assembled (as noted above), is to allow the users 26 to use the device in close proximity to the hazard to be cleaned up. In this way teams of workers can expend energy where needed rather than in a long walk to the device. It permits the workers to attend to the disaster for longer periods of time and allows for fewer workers per device, such that many more devices can be employed around a disaster or work area.

After the body 13 is raised and transported to the device 10 it is presented to the containment team that is waiting at the device 10. The body 13 is then placed into the upper rack 22*u* of trolley 28, the spine board 20, with the body thereon, is positioned inside the trolley locks 281, and the body 13 will be pulled by its ankles, or other lower extremities, until its calves are just barely on the spine board 20. The body 13 is manipulated in this manner to aid in the containment within the containment members (16*a*, 16*b*), as will be described below. It will be understood by persons having ordinary skill in the art that this manipulation is for the ease of containment and that the method can be performed without such manipulation, without departing from the novel scope of the present invention. It will also be understood that in some embodiments of the method of the present invention the attendants lifting the bodies 13 will also comprise the containment team. Users of the device may find that in many cases a tying device of twine or other tying elements (not shown) will be needed to keep the limbs or other extended portions of the body 13 (or other item to be contained) within the perimeter of the board 20 during the containment process. The uses of such tying members, or other tying devices, are contemplated as part of the method and not a departure from the scope thereof.

In the present embodiment a clear polymer film is used as a primary containment means. A tube of clear film 16*a* is provided, preferably on a roll 16 carried by the device 10. The tube is sealed on one end, using a sealing means 18 provided on the device 10, as will be explained below, forming a three sided envelope. The tube is then cut to size (so as to fit over the body 13 and provide an extra length for containment purposes) and then slid over the body 13. The excess material can be rolled into a cuff 16*r* so as to keep the envelope neat and orderly while the process proceeds.

It will be understood that the primary purpose of the first envelope 16*a* is to protect the integrity of the containment system and the attendants 26, as well as helping to maintain the integrity of seals produces as discussed below. In a non-morgue environment, typically a body 13 may hold sharp objects (in the case of an animal, the sharp objects may include claws and teeth), such as keys in pockets. Further, in a combat environment, decedents will more likely than not have sharp objects thereon. As a result a very tough film, such as the clear plastic film shown and described herein will help protect a second bio-seal material such as that which will be discussed below.

Figure 5:
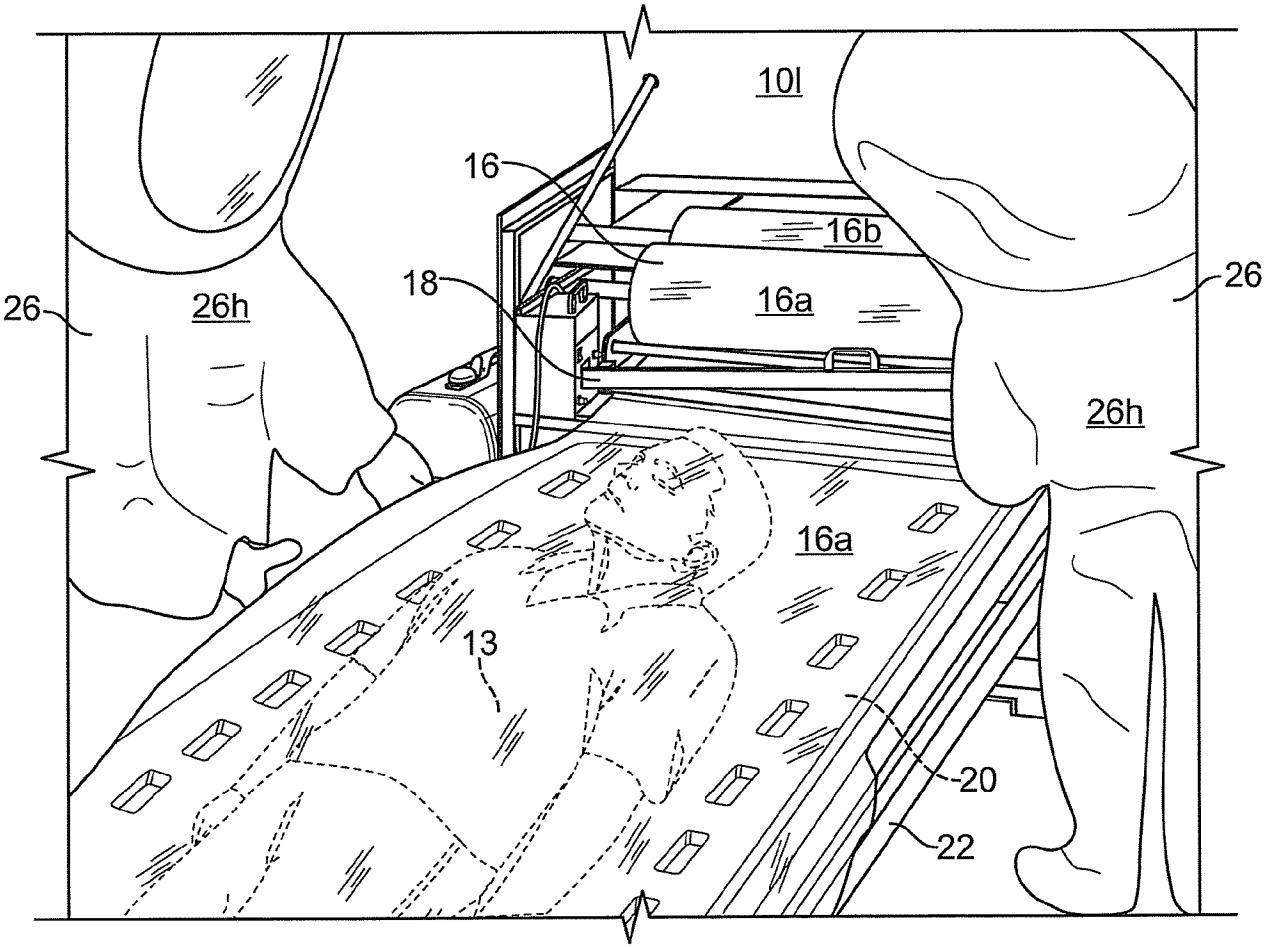
FIG. 5 is a cut-away schematic representation of a step in a method of using the device of the present invention.
Figure 6:
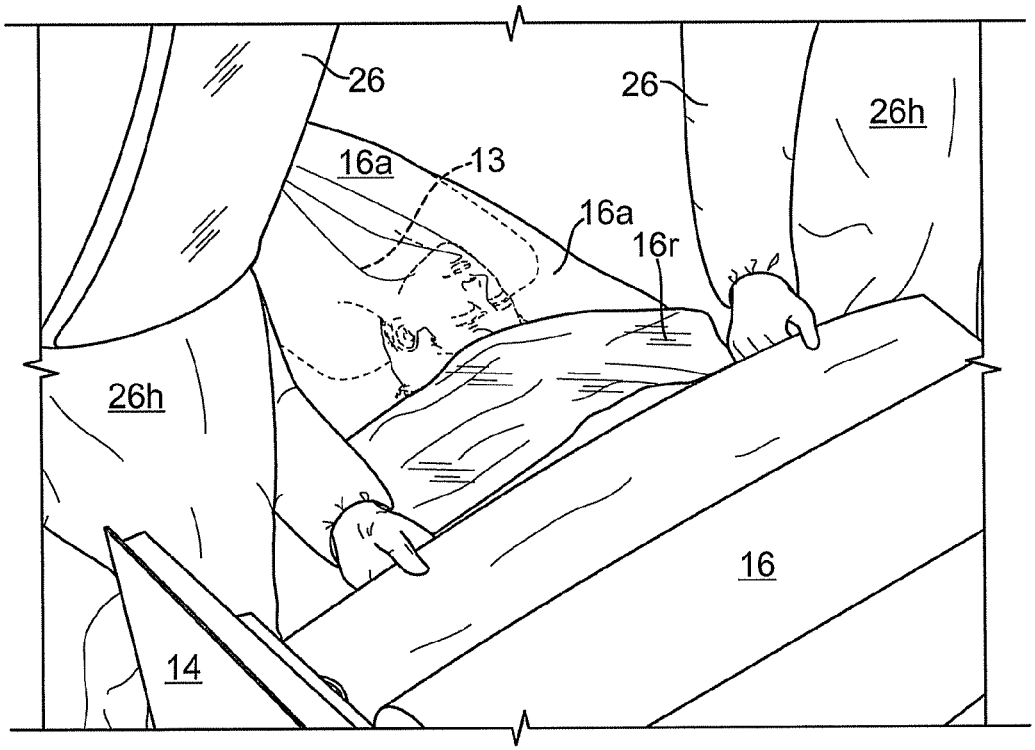
FIG. 6 is a further cut-away schematic representation of another step in a method of using the device of the present invention.
Figure 8:
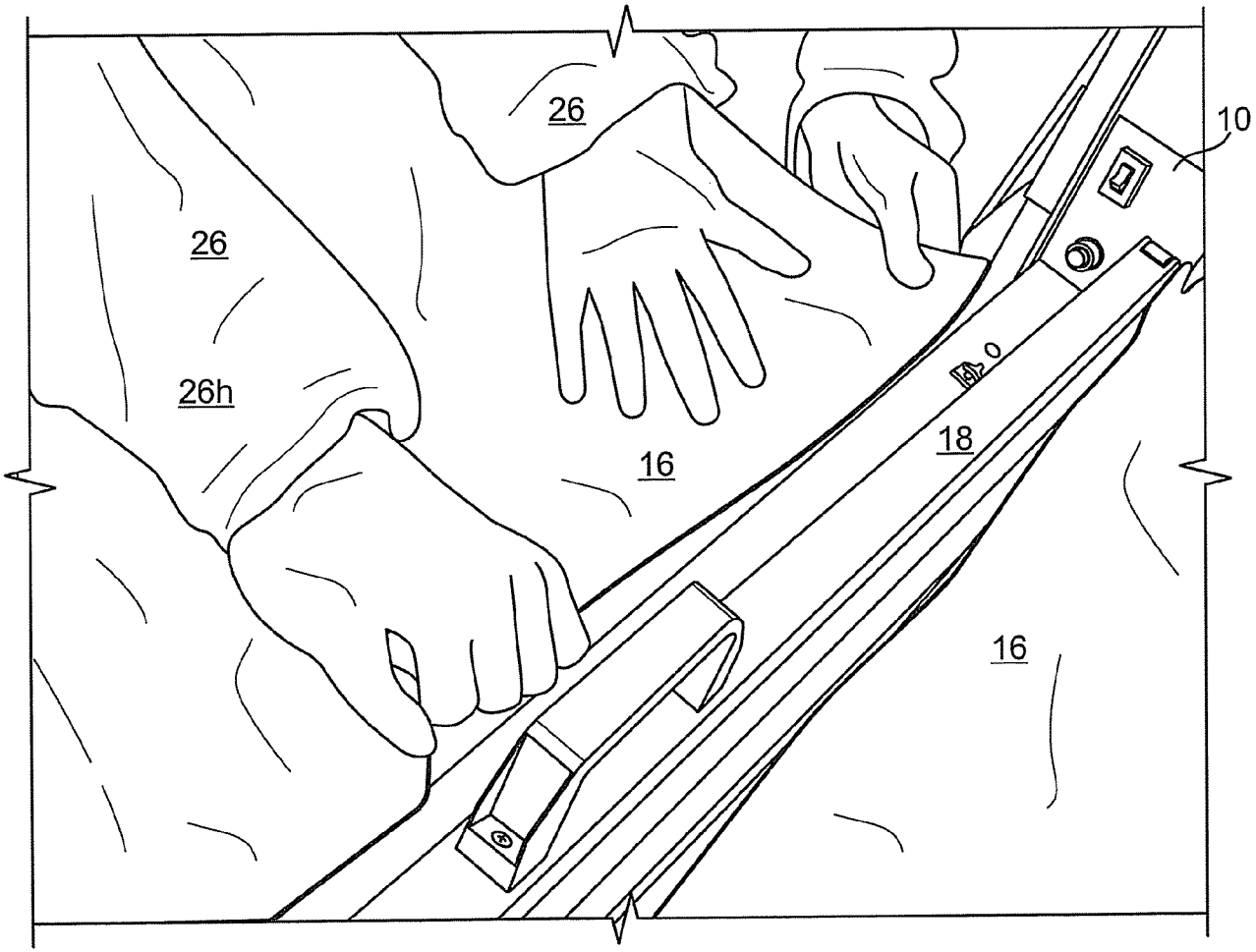
FIG. 8 is a further cut-away schematic representation of another step in a method of using the device of the present invention.
Figure 9:
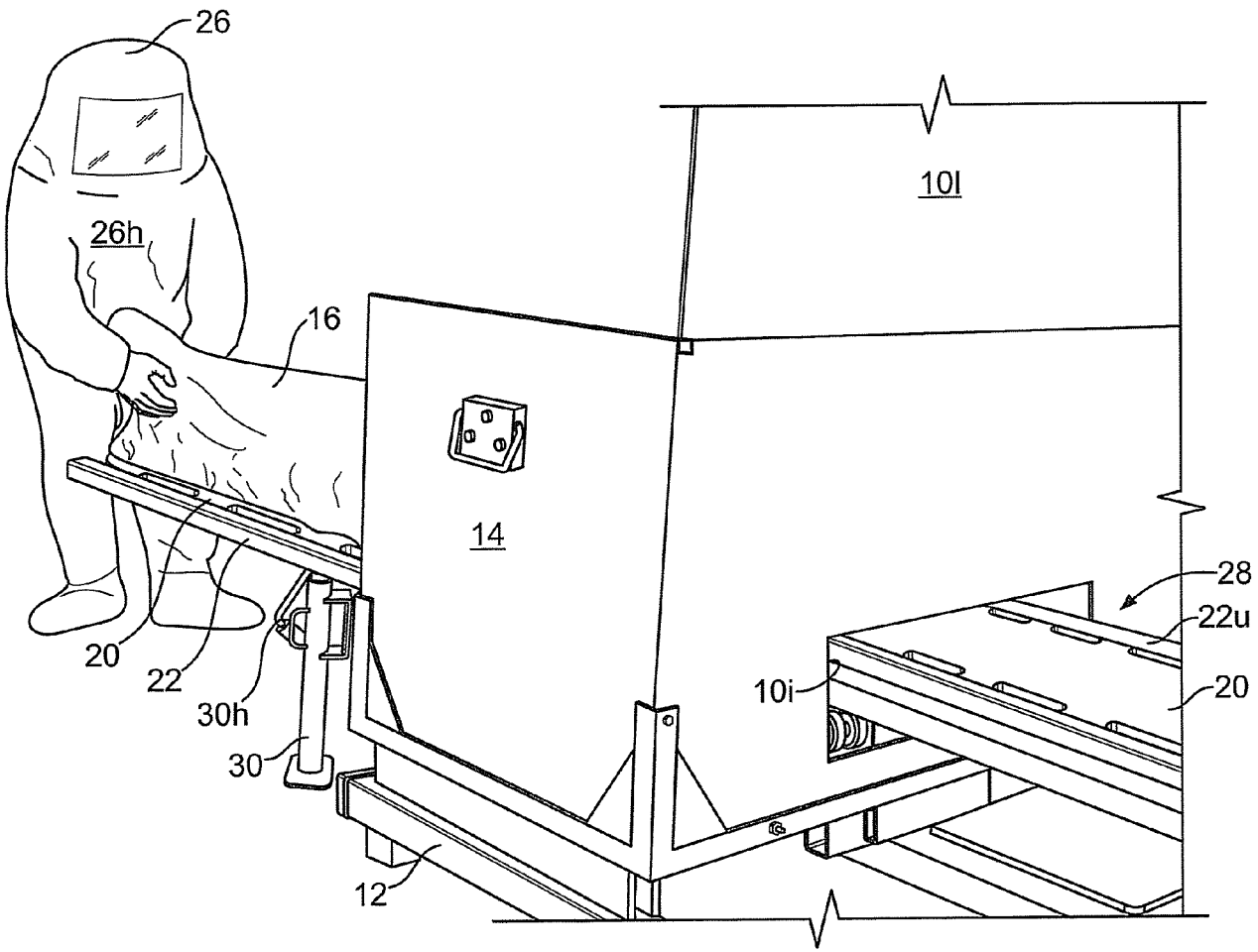
FIG. 9 is a further cut-away schematic representation of another step in a method of using the device of the present invention.
Figure 10:
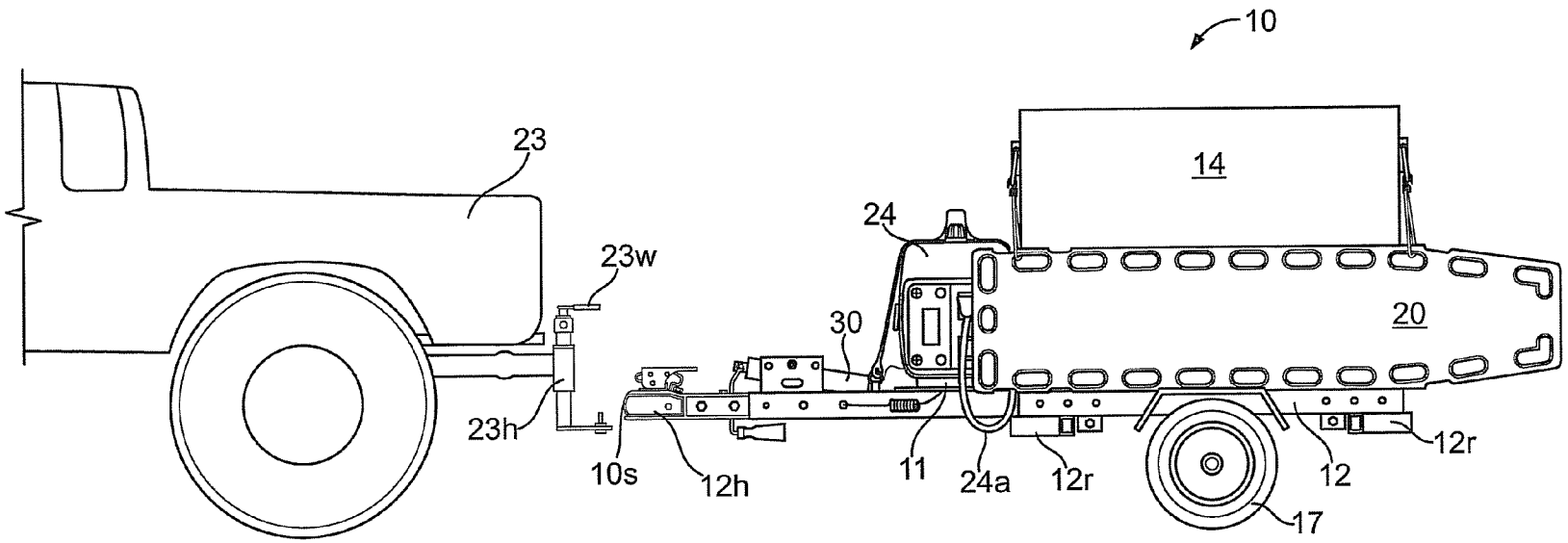
FIG. 10 is a schematic representation of a step of a method of setting up, for use or transportation, the device of the present invention.
Figure 11:
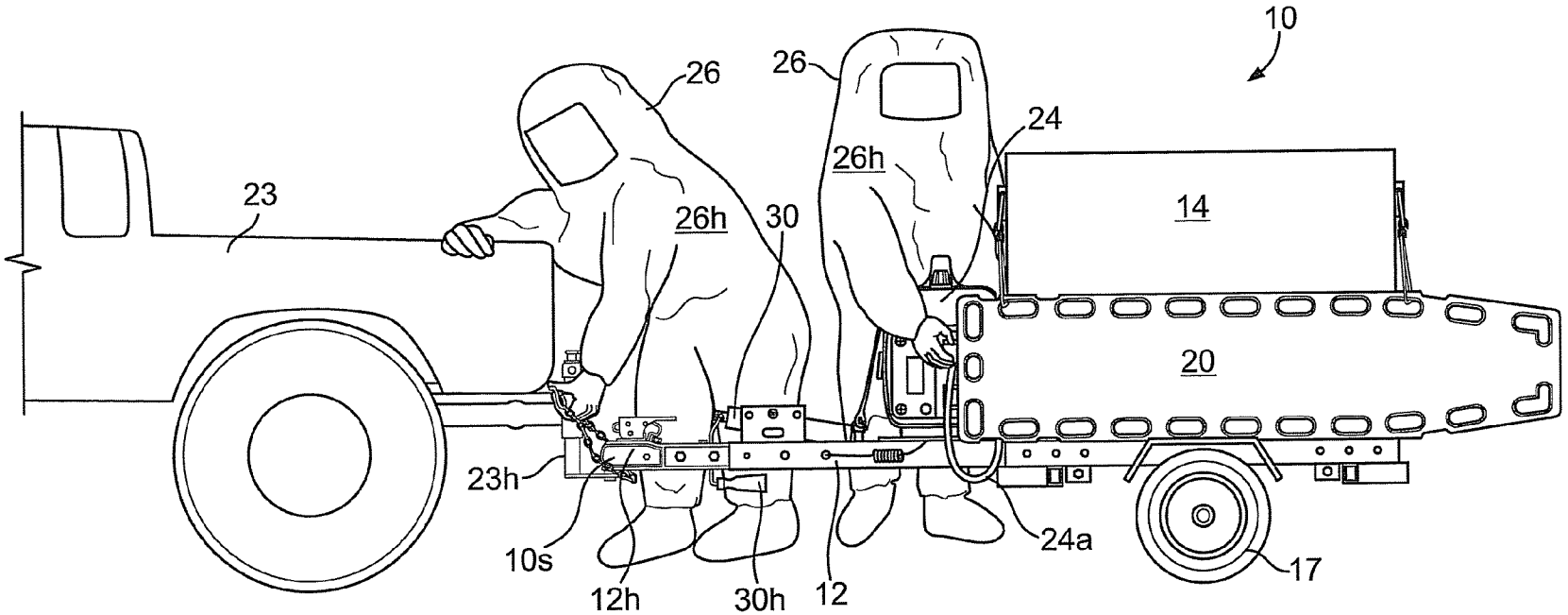
FIG. 11 is a further schematic representation of another step of a method of setting up for use or transportation of the device of the present invention.
Figure 12:
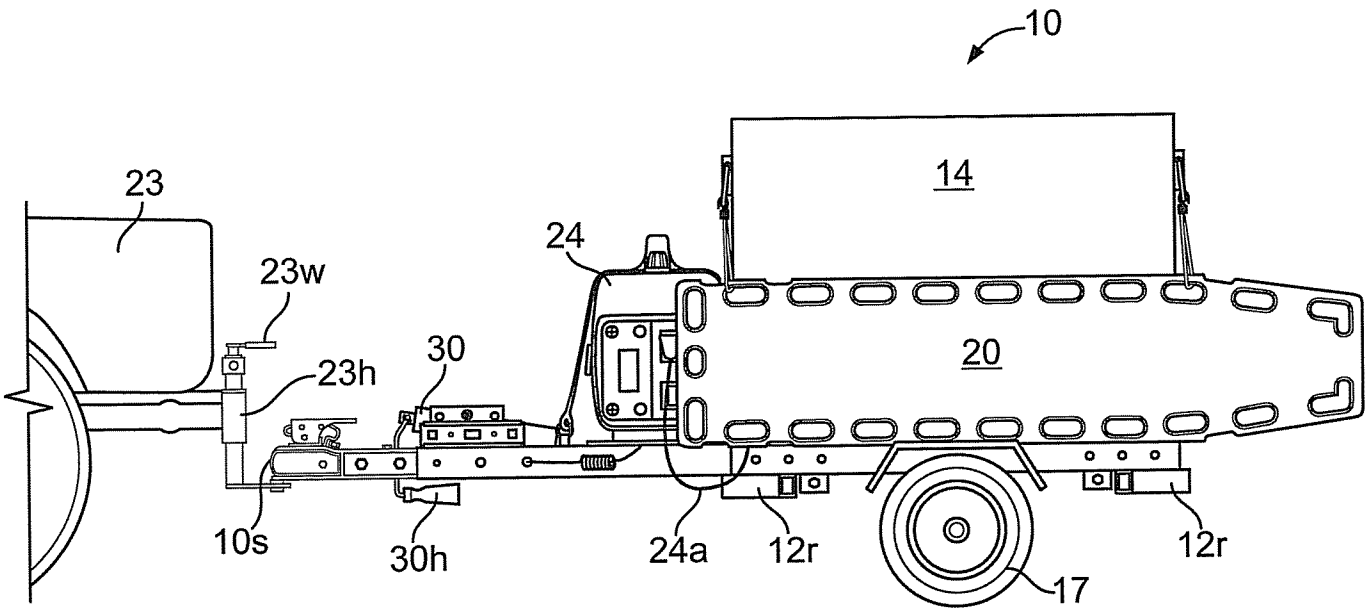
FIG. 12 is a further schematic representation of another step of a method of setting up, for use or transportation of the device of the present invention.
Figure 13:
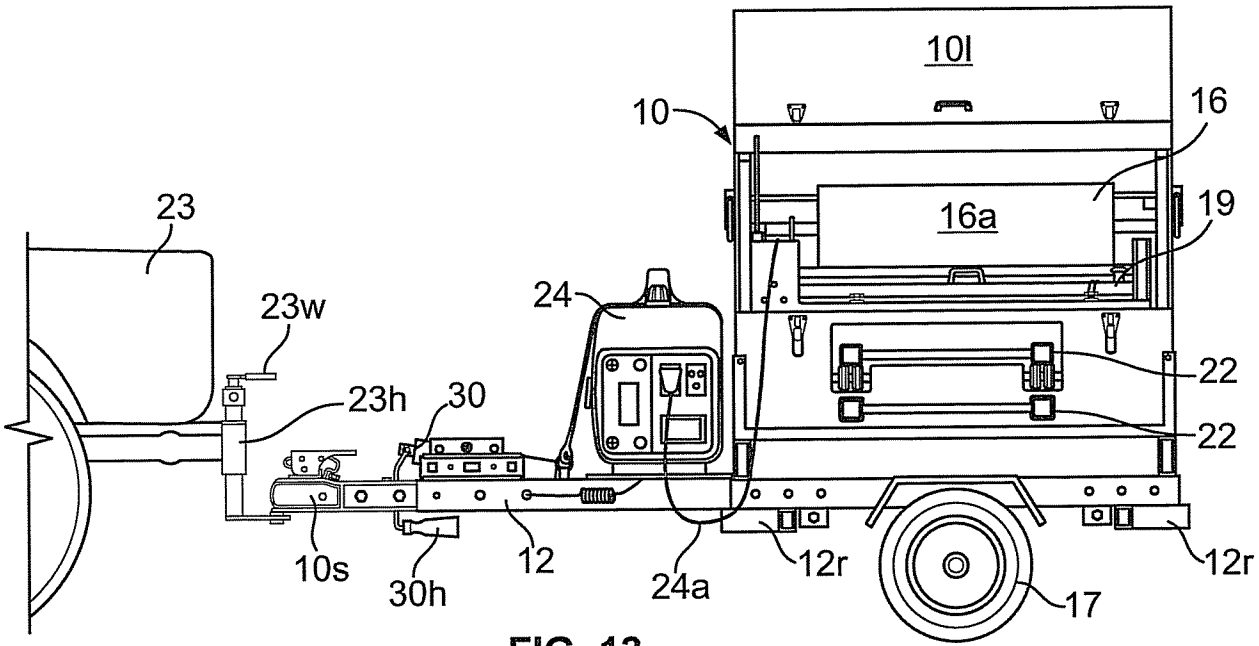
FIG. 13 is a further schematic representation of another step of a method of setting up the device of the present invention.
Figure 14:
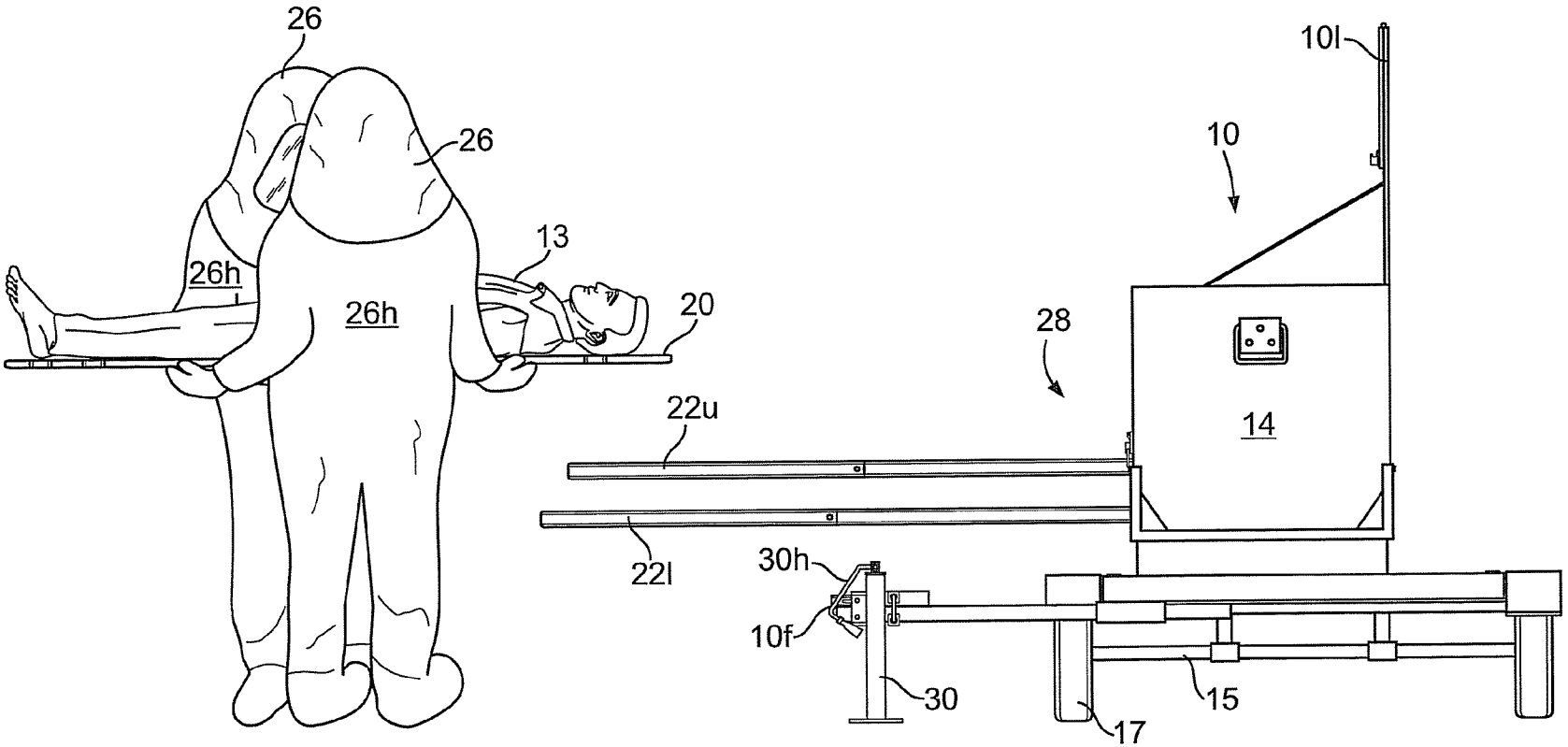
FIG. 14 is a schematic representation of a step in a method of using a device of the present invention.
Figure 15:
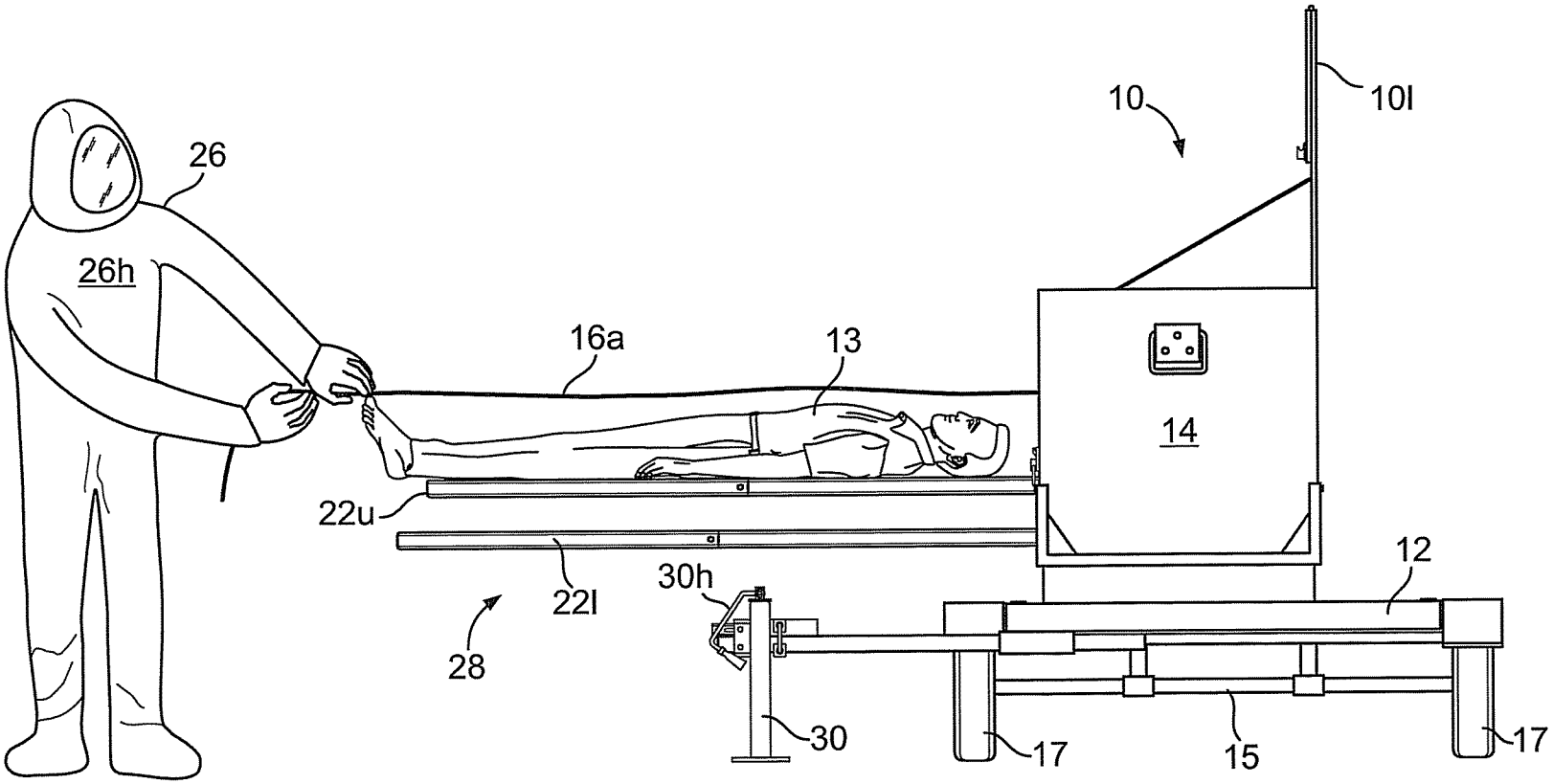
FIG. 15 is a further schematic representation of a subsequent step of a method of using a device of the present invention.
Figure 16:
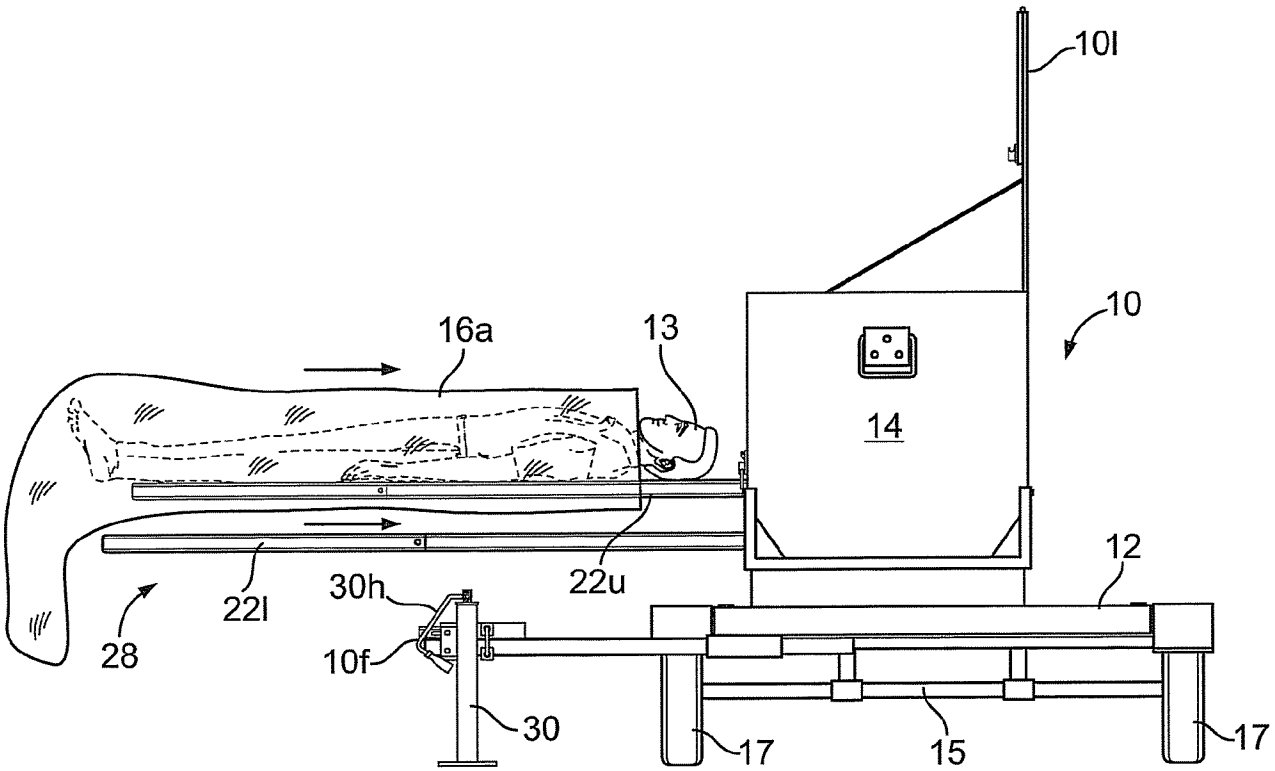
FIG. 16 is a further schematic representation of a subsequent step of a method of using a device of the present invention.
Figure 17:
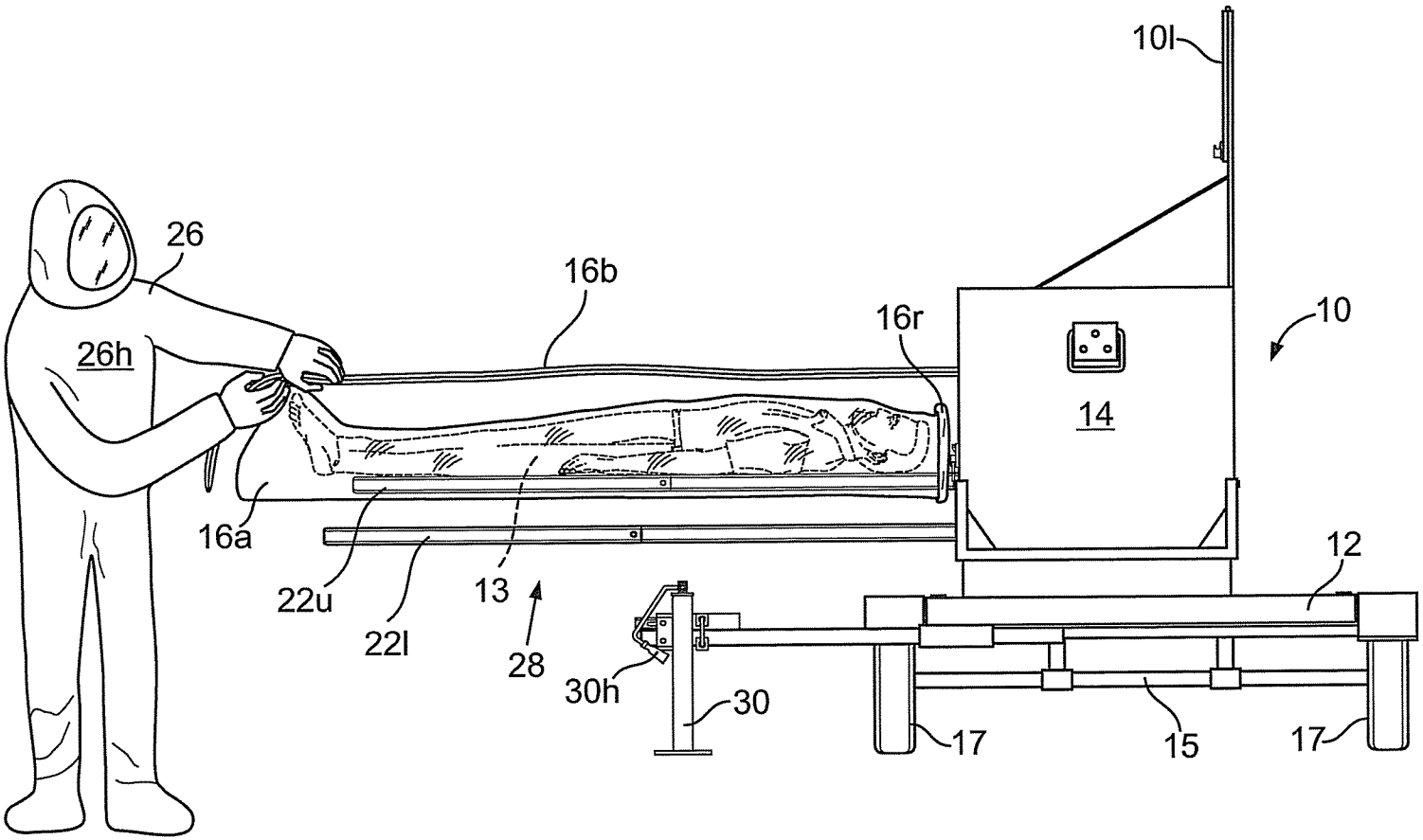
FIG. 17 is a further schematic representation of a subsequent step of a method of using a device of the present invention.
Figure 18:
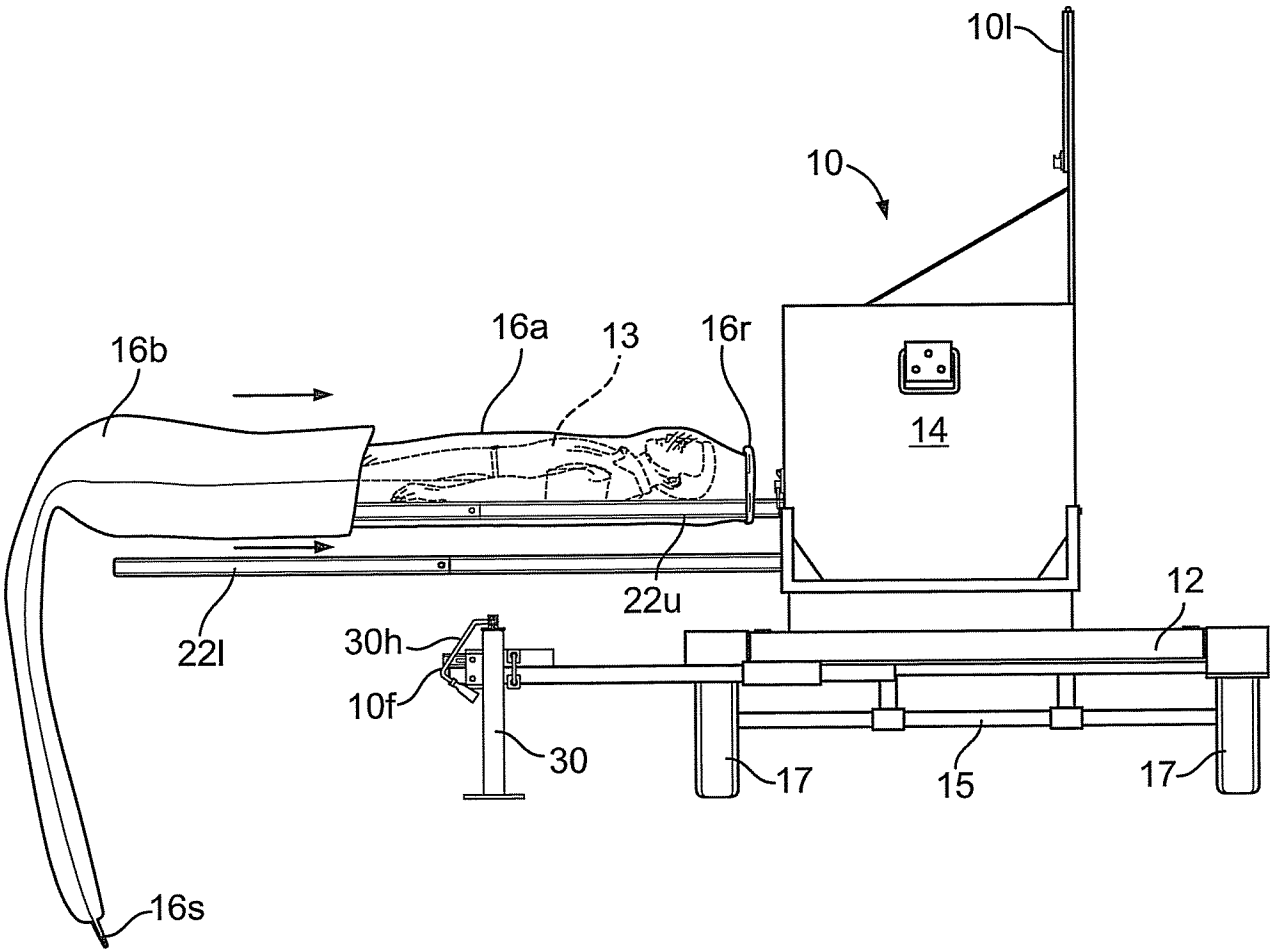
FIG. 18 is a further schematic representation of a subsequent step of a method of using a device of the present invention.

Subsequent to the containment of the body 13 in the clear plastic protective film envelope 16*a*, the attendants 26 will then seal the body 13 in a bio-seal material envelope 16*b*; created from such as the material shown and described in detail in the patent first above-mentioned (U.S. Pat. No. 5,659,933, incorporated herein by reference). The bio-seal material envelope 16*b* is also provided in tube form and carried on the device 10 of the present invention, preferably in rolls 16. The attendants 26 will pull, off of roll 16, an amount of bio-seal material 16*b* measured to fit over the body (plus some slack to provide a sealing portion 16*s*). The first open tube end of the material 16*b* is sealed shut using the sealing bar 18 shown in FIGS. 5 and 8. In a preferred embodiment the seal bar 18 is pressed down more than once onto the materials (16*a* and 16*b*); in a spaced apart generally parallel location along the tubular material 16*a*, 16*b*, so as to double seal the tube. The attendant 16 then uses a cutting knife 19 (FIG. 13), which is built into the device in a preferred embodiment, to cut the sealed area of the tube away from the material roll 16. In the preferred embodiment, when the initial tube of material is freed from the roll 16, the cut is made beyond the seal such that the attendant has a sealed metalized (bio-seal material) pouch on three sides.

In a preferred embodiment of the present invention, the containment element as shown and described is a bag or envelope that will be formed about the item to be contained. More specifically, the containment element is required to have certain properties that will provide for long term containment of human or animal remains and which should prevent the escape of odorous decomposition gases or harmful decomposition fluids into the ambient surroundings from such remains over extended periods of time, with or without refrigeration of the remains. The present invention also provides for infusion or extraction of gases, to retard the decomposition of contained remains. It would be desirable to use the device of the present invention to provide absolute containment of the contents within the bags or envelopes.

In one broad embodiment, the container used in the present invention comprises flexible walls defining and enclosing an interior chamber of dimensions sufficient to accommodate the remains; a closable opening in the walls providing access to the interior chamber for placing the remains therein; the walls comprising a multilayer laminate comprising two layers of polymeric sheet material having adhered there between and coextensive therewith a layer of metal foil. The walls of the container being impervious to gas and liquid; whereby when the remains are placed in the interior chamber and the opening is closed, gases and fluids generated by the remains are contained within the chamber and do not exude through the walls for an extended period of time.

In another embodiment, the invention includes a container wherein the walls comprise at least three the polymeric layers with at least two interleaved metal foil layers. The polymeric layers normally will be layers of polyolefin, nylon or polyvinyl sheet materials, particularly polyolefin materials such as polyethylene or polypropylene, although other polymeric sheet materials with equivalent properties may also be used. The metal foil will normally be aluminum foil, because of its ready availability and reasonable cost, although other metal foils with equivalent properties may also be used. Optionally one may also include other types of sheet materials with which the polymeric and metal layers will bond suitably; as an example, one may include layers of paper, especially Kraft paper. All layers will be bonded into the laminate over their entire surface extent to form the materials for use in fabricating the containers of embodiments of this invention.

As described herein, and shown in the drawings, the containers are preferably generally tubular in shape when open, may be of any convenient cross section (which will be variable since the wall materials are flexible), and will have a closable, sealable opening at one end, and preferably one at each end, simplifying insertion of the remains into the container. The open ends are readily closable and are commonly sealed by heat sealing or adhesives. The tubular containers can also be furnished in a flattened configuration to the end user, and joined together at their respective ends, which permits them to be coiled into large rolls from which the user merely cuts off desired lengths as needed and forms the individual bags.

The roll structure is also useful for dispensing other types of containment bags, and the heat or adhesive sealing method can be used on such bags formed by severing from the elongated roll. Such bags can be used for temporary short-term retention of bodily remains.

Figure 19:
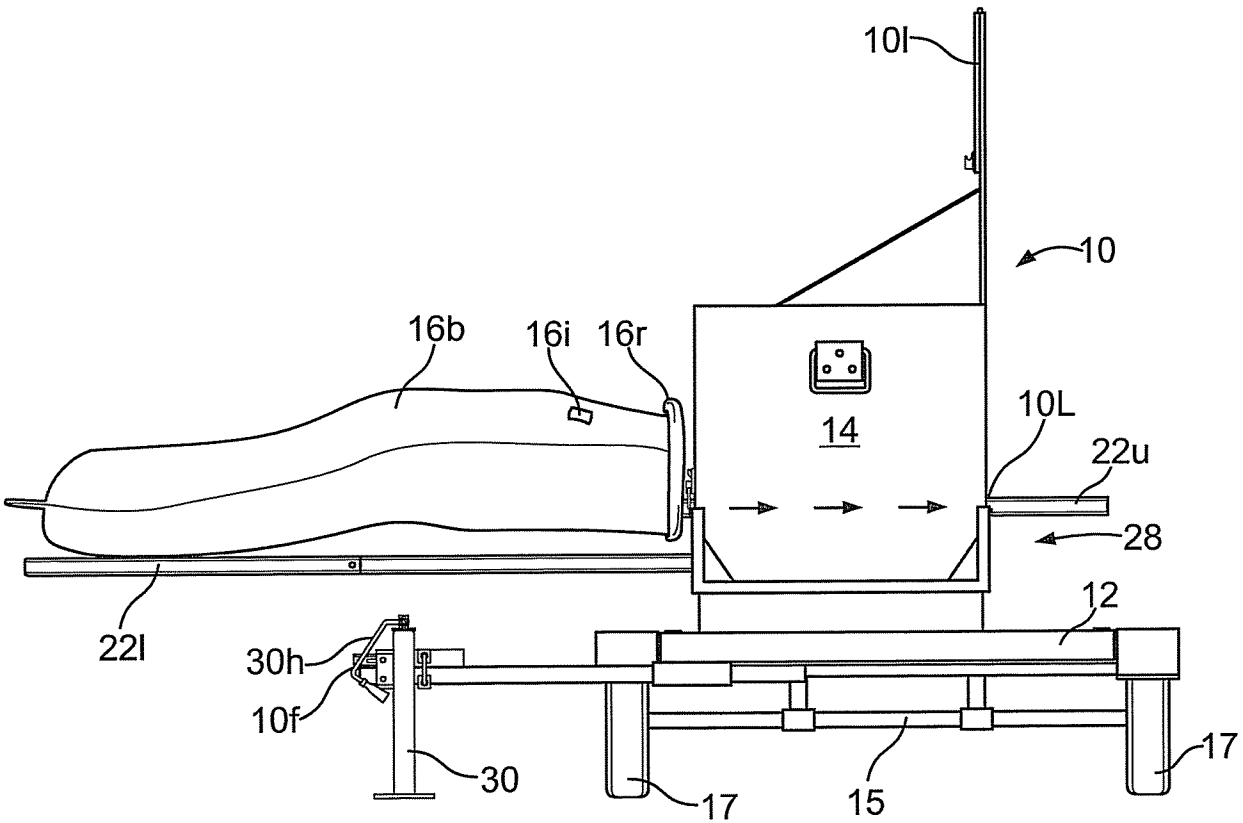
FIG. 19 is a further schematic representation of a subsequent step of a method of using a device of the present invention.
Figure 20:
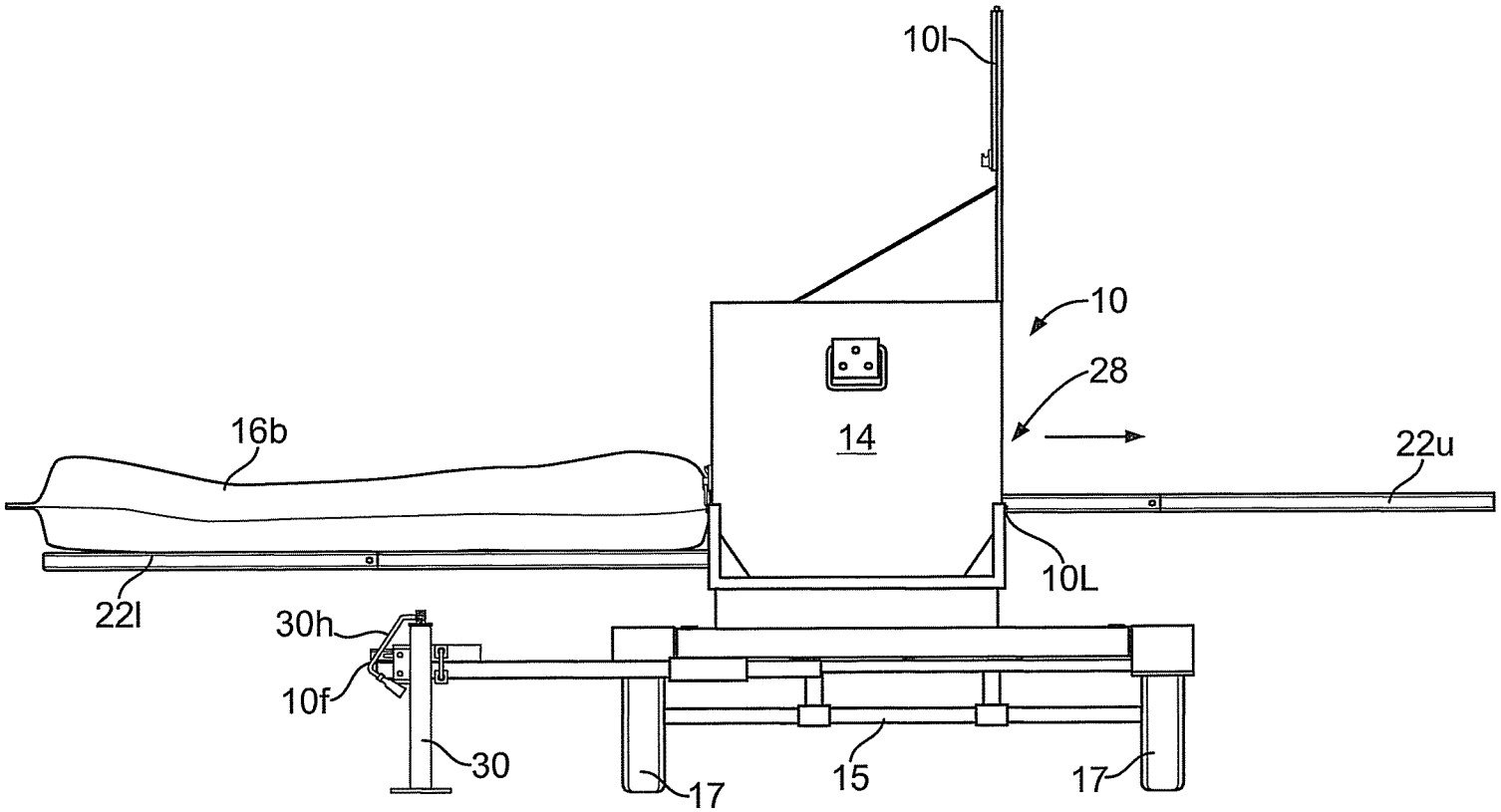
FIG. 20 is a further schematic representation of a subsequent step of a method of using a device of the present invention.
Figure 21:
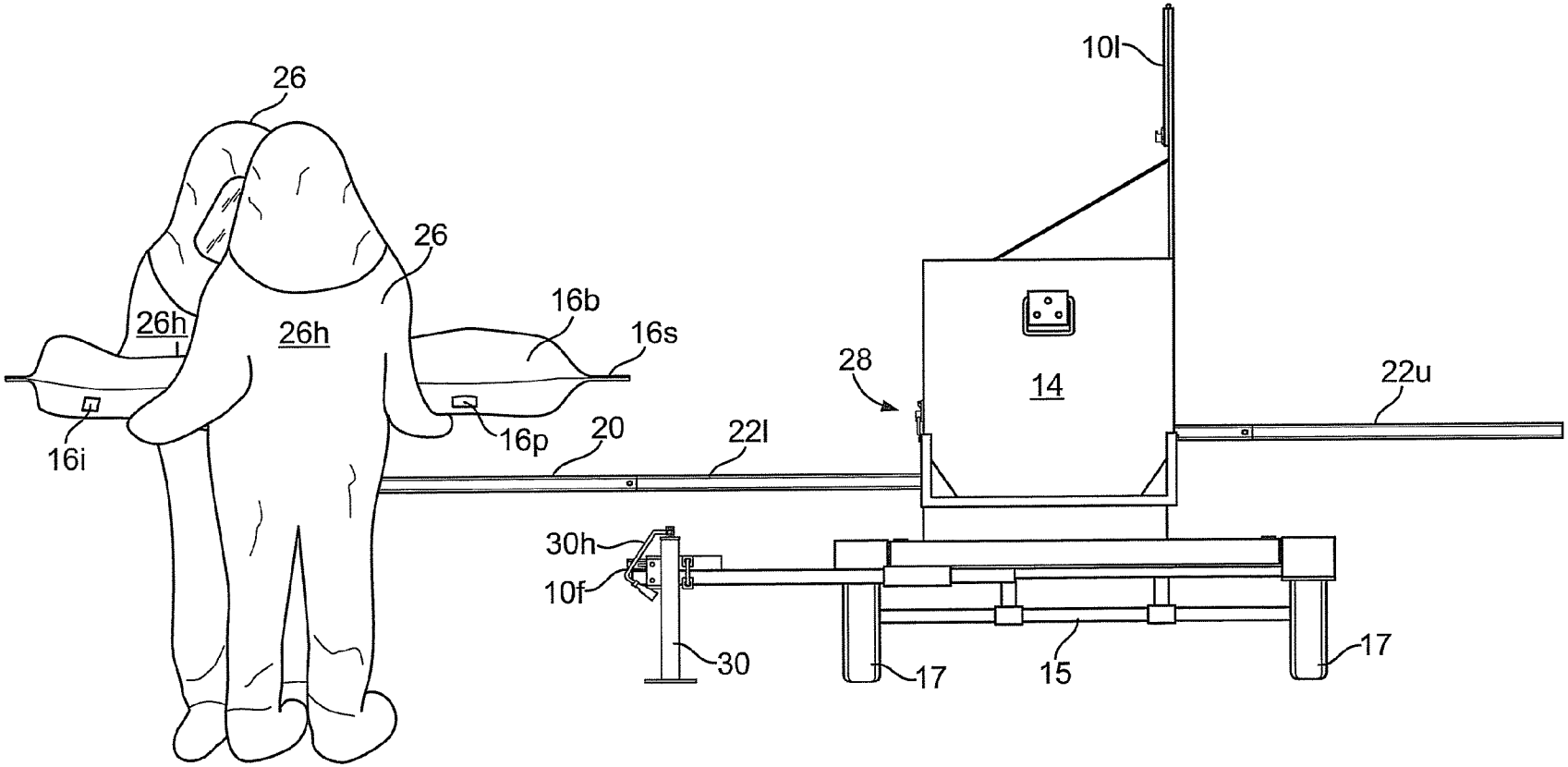
FIG. 21 is a further schematic representation of a subsequent step of a method of using a device of the present invention.
Figure 22:
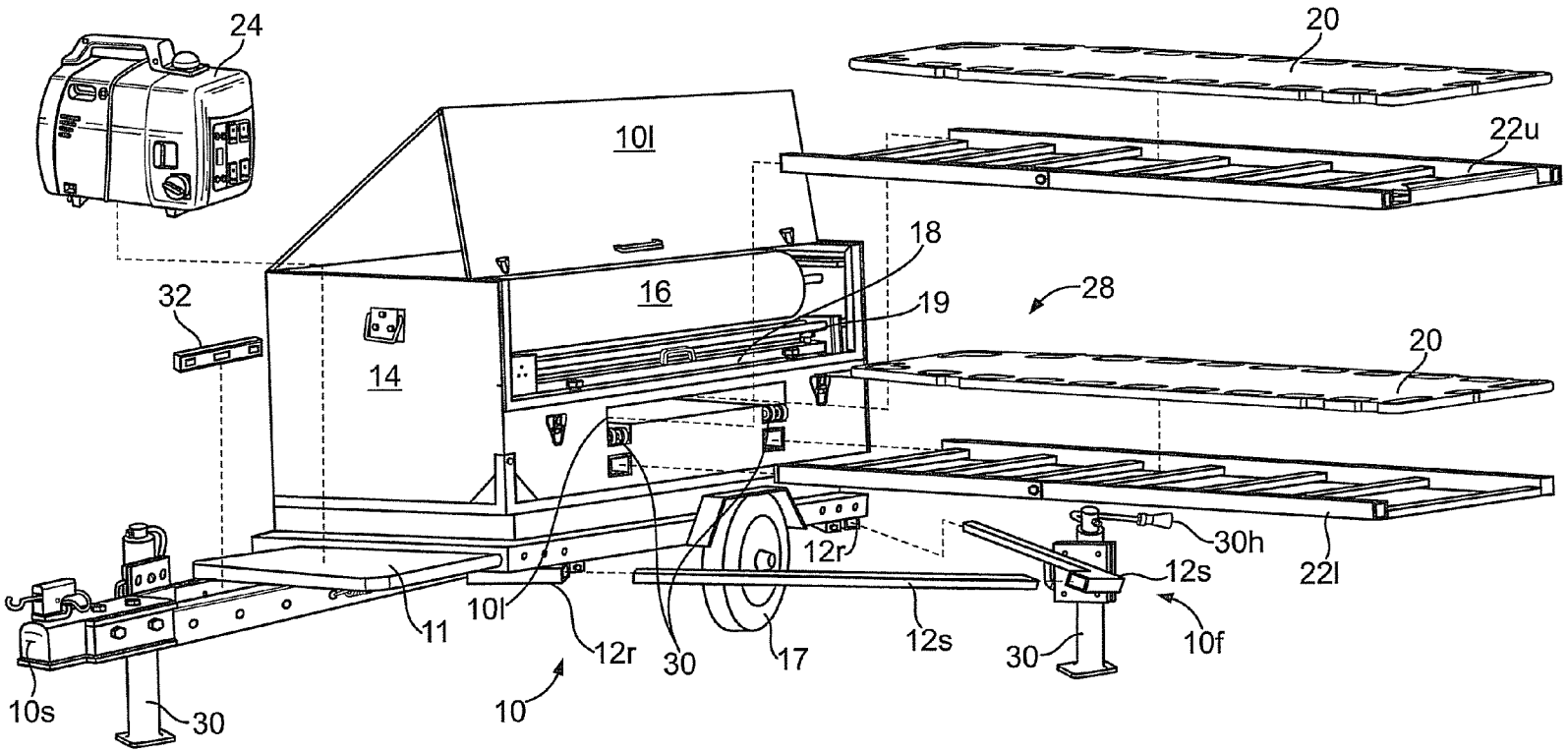
FIG. 22 is an exploded perspective showing various elements of a device made in accordance with the teachings of the present invention.

It will be understood that the preferred bio-seal material 16*b* comes sealed on two sides from the factory; the attendants 26 in the present embodiment will seal the third side using sealing member 18 at the beginning of their work. The attendants 26 will then slide the three sided pouch over the first layer of polymer film 16*a* and the body 13. The excess material of the first layer of polymer film 16*a* will be rolled down and into the second layer pouch 16*b* so as to keep the first layer film 16*a* from getting caught on the rollers 30 of the device. One attendant 26 will then pull on the upper rack 22*u* such that it can slide, in the trolley 28 through window 10*i* and out from underneath the body 13; the body 13 will then gently drop onto the lower rack 22l as illustrated in FIG. 19. The attendants 26 will then take the first layer plastic material 16*a* out of its rolled away configuration, place it into the sealing bar 18 and seal it. The attendants 26 will then stuff the sealed first layer back into the pouch 16*b* (second, bio-seal layer). The attendants 26 will then take the bio-seal material 16*b*, straighten it out so that it is flat, place it into the sealing bar 18 and seal it. The attendants, in a preferred embodiment will then move the material 16*b* slightly and seal a second location of the material so as to form a double seals on both sides as illustrated herein. The absolute containment of the contents using heat sealing is a desired standard.

Figure 7:
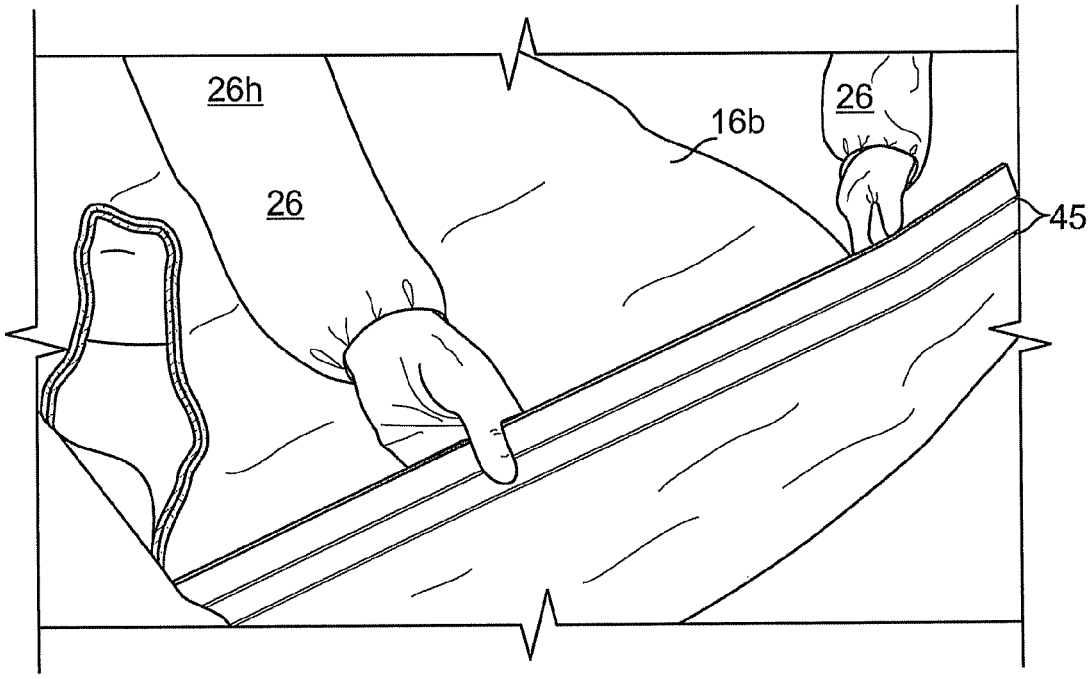
FIG. 7 is a further cut-away schematic representation of another step in a method of using the device of the present invention.

As will be understood by persons having ordinary skill in the art, and in summary, in a preferred embodiment, the polymer material is pulled off in measured lengths that are only as much as needed to cover the body 13 presented, along with some slack so that the end of the material can reach to and be sealed by the sealing element 18. The polymer 16*a* is slid over the body 13 up to the device and rolled back into a cuff 16*r* so that it doesn't get caught in the positioned wheels 30. Once this is achieved, the attendants 26 will follow a similar procedure to enclose the body 13 in the bio-seal material 16*b*. It will be understood that if there is a two foot long victim 13 the attendants 26 would only use about four linear feet of material 16; if there is a three foot victim 13, the attendants 26 would probably only use five linear feet of material 16. It will be understood that one important aspect of the invention is the efficiency of this system, that is only as much material as is needed is used. The attendants 26 will make a three-sided, sealed bio-seal pouch that in a preferred embodiment is sterile inside. The attendants or users 26 open the three sided pouch, slide it up over the body 13, leaving a length of slack material at the end of the envelope adjacent to the device, for sealing purpose and so that the bag can reach up to the sliding seal bar after the body 13 drops down to the second rack. Once the body is placed within first envelope, a pin 50, holding rack 22*u* in place on the trolley 28 is released, rack 22 is pulled through device window 10*i* on wheels 30, the body 13 drops down to the second rack 22l. The operators 26 then seal the first poly liner 16*a* and tuck it into second envelope 16*b*. Then the operators 26 unroll and seal the bio-seal material 16*b*, flatten it out to eliminate creases and crimps, place it in the sealing bar 18, seal it once, move the material slightly and seal it again for a double seal 45 (FIG. 7).

It will be understood by persons having ordinary skill in the art, that pre-cut envelopes of various size can be provided, in one or more embodiments of the invention, instead of or in addition to the rolls of material, without departing from the novel scope of the present invention. The users 26 of the device can then select an appropriately sized envelope for the body or item to be contained. Such pre-cut envelopes and their use are within the novel scope of the present invention.

In a preferred embodiment, the elapsed time to seal a body 13, from the time it is placed in position on device 10, is initially about 2 minutes. It will be understood that by the time a team has performed this operation on several bodies elapsed time will diminish reaching, in a preferred embodiment, about one minute per body for a two member team. This is important because these workers who are in their Level One gear (the large cumbersome gloves and breathing apparatus shown) typically will have only 20-30 minute work cycles available before they have to retire out of the so called "hot zone". Users 26 of the device and method will then need to reload, rest, and re-hydrate themselves prior to returning to work. It will be understood that users of the device can take as much time as needed to properly do the work assigned without departing from the novel scope of the present invention.

It will therefore be understood that where speed and efficiency are critical, a preferred embodiment of the device and method allows users to have a lift team continuously providing items to be contained to the containment team. It will be understood by persons having ordinary skill in the art that items contained as described herein can be maintained in storage, without refrigeration for approximately 5 days.

In a further embodiment, once the item is contained as described above, the body 13 can be transported to a waiting refrigerated truck or transport platform. It has been determined that with refrigeration, these bodies or other items, can be held indefinitely.

In a further embodiment, an identification device 16*i* or structure can be attached to the contained remains (either within or on the packaging materials 16) so that identification of the remains can be made without opening the envelopes. Such elements as RFID devices, bar code labeling, simple name labeling, DNA containers and others can be provided, in a manner know to persons having ordinary skill in the art, without departing from the novel scope of the present invention. With respect to the use of RFID devices, remains can, subsequent to storage, be found relatively easily, so as to assuage some of the grief which occurs to loved ones who cannot find remains and have closure. So as to facilitate identification, another embodiment of the device and method includes a resealable port 16*p* through which a hypodermic needle, or other probe or device, can be inserted to retrieve a tissue or blood sample from the remains within the envelope for testing and identification.

In a further embodiment, it will be understood that with the appropriate trailer carriage and vehicle the device is transportable into almost any type of terrain or territory. When a generator is included with the device, the method of the present invention can be practiced in almost any area or terrain as well.

As shown and described, the device can be relocated and re-leveled for continued use in a short period of time. It will be further understood that the device can even be leveled on a rough terrain very quickly and simply. It will also be understood by persons having ordinary skill in the art that many of the elements of the device of the present invention are off-the-shelf tools and implements.

In another embodiment, when there is a vectored dead animal that must be cleared from a site, a pouch that is easily transportable and can hold a small transport web can be used instead of a large spine board. The pouch is opened and the transport web removed, the dead animals are placed on the web and are transported to the device in a manner similar to that described above for a human body. Briefly, the animal is placed on the first rack 22*u* and sealed within the first poly-seal material envelope 16*a*. While it may seem that an animal will not have sharp objects thereon, it will be understood that animals have teeth, talons and claws, from which the users 26 and others must be protected. Once sealed in the first poly-bag liner, the animal will then be sealed in the second or bio-seal liner envelope 16*b* in a manner concomitant to that described above. Such an embodiment would be critical to a veterinary response effort to control the vectors that will be moving whatever it is around the environment. It is a particularly important in light of the threat of bird flu and potential mass euthanasia of fowl.

As has been described and shown the present invention comprises a device that can be stored forever, brought out of storage and attached easily to almost all of the emergency responsive vehicles that are shared across all the different government agencies. It can then be easily transported to the disaster scene, set up quickly and easily within three to five minutes. It can then be maneuvered into a hot zone, utilized, and then moved out of the "hot zone", disassembled, decontaminated and stored again.

An important aspect is the bio-seal system material—a poly-aluminum poly-laminate developed by Barrier Products, the owner of the present invention, and patented by Barrier Products. U.S. Pat. No. 5,659,933 (incorporated herein by reference). This material was tested by the U.S. Army's chemical/biological laboratories in Aberdeen Proving Grounds in early 2005, to contain and hold chemical warfare agents. It was also tested and proven by the U.S. Air Force in early 2003 at the Brooks Medical Center to contain pressure to altitudes above 67,000 ft.

Although illustrative embodiments of the invention has been shown and described, it is to be understood that various modifications and substitutions may be made by those skilled in the art without departing from the novel spirit and scope of the invention.

What is claimed:

1. A device for containing hazardous materials or items including human remains, the device comprising:

a portable device carrying containment materials capable of being sealed and means to seal the containment materials;

a top rack to initially support an item to be contained;

said top rack movable relative to said portable device and supported by said portable device;

associated means for easily supplying the containment materials for enclosure of the item;

a bottom rack parallel to the first rack and for supporting the item after enclosure of the item; said bottom rack fixed relative to said portable device and supported by said portable device;

said top rack reciprocally moving into and out of said portable device; and means for sealing the containment materials so as to contain the materials or item to be contained.

2. The device of claim 1, wherein the device includes an automobile trailer for transporting the portable device from one location to another.

3. The device of claim 1, wherein the top rack for supporting an item to be contained includes a trolley, the top rack capable of supporting at least a weight of an adult human.

4. The device of claim 1, wherein the containment materials are comprised of plastic film.

5. The device of claim 1, wherein the containment materials are comprised of plastic film lined with metal.

6. The device of claim 1, wherein the associated means for supplying containment means are a roll of plastic film journaled within the device such that a user may select a sufficient portion of film by puffing material from the roll to enclose the item to be contained.

7. The device of claim 1, wherein the means for supplying a containment means are a first and second roll of containment materials carried by the portable device so that the item to be contained can be sealed in a first film and then the item within the first film can be enclosed in a second film.

8. The device of claim 1, wherein the device is powered by electricity, the electricity being supplied by the battery of an associated towing vehicle.

9. The device of claim 1, wherein the device is powered by electricity, the electricity being provided by a portable generator associated with the device.

10. The device of claim 1, further comprising:

a structure for holding a supply of containment materials; and a means to provide a sufficient portion of at least one containment material.

11. The device of claim 1, wherein the device has means to hold at least one spool of containment material held so that containment material can be unspooled from the structure for use.

12. The device of claim 11, wherein the at least one spool of containment material is a tube of flexible plastic material.

13. The device of claim 11, wherein the at least one containment material is a first tube of a first flexible plastic material and a second tube of a second flexible plastic material, each situated for use in concentrically containing the item to be contained within the first and second plastic material.

14. The device of claim 11, wherein the device has a first and second means for holding spools of containment material such that the first and second tubes of flexible plastic material can be unspooled from the structure.

* * * * *